US012129580B2

(12) United States Patent
Lonati et al.

(10) Patent No.: US 12,129,580 B2
(45) Date of Patent: Oct. 29, 2024

(54) PICK-UP DEVICE FOR PICKING UP A TUBULAR KNITTED ARTICLE FROM A CIRCULAR KNITTING MACHINE AND FOR ITS TRANSFER TO A UNIT ADAPTED TO PERFORM ADDITIONAL OPERATIONS ON THE ARTICLE

(71) Applicant: LONATI S.P.A., Brescia (IT)

(72) Inventors: Francesco Lonati, San Felice del Benaco (IT); Ettore Lonati, Brescia (IT); Fausto Lonati, Brescia (IT)

(73) Assignee: Lonati S.P.A., Brescia (IT)

( * ) Notice: Subject to any disclaimer, the term of this patent is extended or adjusted under 35 U.S.C. 154(b) by 0 days.

(21) Appl. No.: 17/291,354

(22) PCT Filed: Nov. 13, 2019

(86) PCT No.: PCT/EP2019/081132
§ 371 (c)(1),
(2) Date: May 5, 2021

(87) PCT Pub. No.: WO2020/211968
PCT Pub. Date: Oct. 22, 2020

(65) Prior Publication Data

US 2022/0034007 A1 Feb. 3, 2022

(30) Foreign Application Priority Data

Apr. 16, 2019 (IT) ..... 102019000005838

(51) Int. Cl.
*D04B 9/40* (2006.01)
*D04B 9/42* (2006.01)
(Continued)

(52) U.S. Cl.
CPC ..... *D04B 9/40* (2013.01); *D04B 9/42* (2013.01); *D04B 9/46* (2013.01); *D04B 15/02* (2013.01)

(58) Field of Classification Search
CPC ... D04B 9/40; D04B 9/42; D04B 9/46; D04B 9/48; D04B 9/50; D04B 9/52; D04B 15/02
(Continued)

(56) References Cited

U.S. PATENT DOCUMENTS 9,365,962 B2 6/2016 Lonati et al.
2001/0017046 A1* 8/2001 Rumi ..... D05B 23/007 66/58
(Continued)

FOREIGN PATENT DOCUMENTS

CN 1723308 A 1/2006
CN 101970740 A 2/2011
(Continued)

OTHER PUBLICATIONS

Examination Report issued for India Patent Application No. 202137018211 dated Mar. 15, 2022, 6 pages.
(Continued)

*Primary Examiner* — Aiying Zhao
(74) *Attorney, Agent, or Firm* — Quicker Law, LLC

(57) ABSTRACT

A pick-up device for picking up a tubular knitted article from a circular knitting machine, comprising an annular pick-up body which supports pick-up elements which can slide relative to the pick-up body along radial directions. The end of each one of the pick-up elements has a seat which can engage a region of the stem of the needle located proximate to the latch of the needle on the opposite side with respect to the head of the needle. The device comprises actuation elements formed by elastic elements which act on the
(Continued)

pick-up elements for their sliding toward the axis of the pick-up body and radial pushers which act on the pick-up elements for their sliding away from the axis of the pick-up body in contrast with the action of the elastic elements.

14 Claims, 16 Drawing Sheets

(51) Int. Cl.
*D04B 9/46* (2006.01)
*D04B 15/02* (2006.01)

(58) Field of Classification Search
USPC ..... 66/58, 59, 148
See application file for complete search history.

(56) References Cited

U.S. PATENT DOCUMENTS

| | | | | |
|---|---|---|---|---|
| 2001/0039816 | A1 | 11/2001 | Fujiwara et al. | |
| 2006/0144095 | A1* | 7/2006 | Frullini | D04B 9/40 66/8 |
| 2010/0313607 | A1* | 12/2010 | Lonati | D04B 9/40 66/148 |
| 2010/0313608 | A1 | 12/2010 | Lonati et al. | |
| 2010/0319408 | A1* | 12/2010 | Lonati | D04B 15/02 66/149 R |
| 2017/0241052 | A1* | 8/2017 | Conti | D04B 9/40 |
| 2018/0327944 | A1 | 11/2018 | Lonati et al. | |
| 2019/0301062 | A1* | 10/2019 | Lonati | D04B 15/02 |

FOREIGN PATENT DOCUMENTS

| | | | | |
|---|---|---|---|---|
| CN | 108291340 | A | 7/2018 | |
| CN | 109477261 | A | 3/2019 | |
| EP | 0679746 | A2 | 11/1995 | |
| EP | 0942086 | A | 9/1999 | |
| EP | 2377979 | A1 * | 10/2011 | D04B 15/02 |
| WO | 02/070801 | A1 | 9/2002 | |
| WO | 2004035894 | A1 | 4/2004 | |
| WO | 2008028575 | A1 | 3/2008 | |
| WO | 2009/112346 | A1 | 9/2009 | |
| WO | 2009112346 | | 9/2009 | |
| WO | WO-2017067801 | A1 * | 4/2017 | D04B 15/02 |

OTHER PUBLICATIONS

First Office Action issued for Chinese Patent Application No. 201980084149.3 dated Jul. 7, 2022, 13 pages.
International Search Report from corresponding PCT application PCT/EP2019/081132, dated Feb. 3, 2020.
Written Opinion of the International Searching Authority from corresponding PCT application PCT/EP2019/081132, dated Feb. 3, 2020.
Colombian Patent Office (CPO) Office Action (No. 19589) issued for Application No. NC2021/0005465, dated Nov. 30, 2022, with English translation (15 pages).
Examination Report issued for European Patent Application No. 19798679.7 dated Jun. 14, 2023, 5 pages.
Notice of Reasons for Refual issued for Japanese Application No. 2021-553361 dated Jun. 21, 2023, 6 pages.
Office Action re Brazilian Patent Application No. BR112021005569-0, dated Jul. 25, 2023 (2 pages).
English Translation of Office Action mailed Aug. 22, 2023 in Korean Application 10-2021-7021957 (8 pgs.).
English Translation of Examination Report dated Aug. 29, 2023 in Vietnam application 1-2021-03456 (2 pgs.).
English Translation of Office Action received Jan. 11, 2024 in Egyptian Application 2021101622 (2 pgs.).
English Translation of Office Action received Jan. 9, 2024 in Ukraine Application No. a 2021 03358 (6 pgs.).

* cited by examiner

PICK-UP DEVICE FOR PICKING UP A TUBULAR KNITTED ARTICLE FROM A CIRCULAR KNITTING MACHINE AND FOR ITS TRANSFER TO A UNIT ADAPTED TO PERFORM ADDITIONAL OPERATIONS ON THE ARTICLE

This application is a 371 of PCT/EP2019/081132 filed on Nov. 13, 2019, which is incorporated herein by reference.

The present invention relates to a pick-up device for picking up a tubular knitted article from a circular knitting machine for hosiery or the like and for its transfer to a unit adapted to perform additional operations on the article.

BACKGROUND OF THE INVENTION

In the field of the production of tubular knitted articles with circular knitting machines for hosiery or the like, in some cases there is the need to transfer the article from the machine used to produce the article to another production unit to perform additional work on the article that cannot be performed on said machine or that it is not economically convenient to perform on said machine.

In particular, in the field of the production of hosiery, in recent years methods have been developed for the automated execution of the closure of their toe by sewing or linking. Some of these methods are based on picking up the article from the machine used for its production and on its transfer to a station for additional work, which is distinct from the production machine, so as to close the toe of the hosiery item in the additional work station while the machine is used to produce another hosiery item. These methods have the advantage, with respect to other methods that are based on the execution of the closure of the toe of the hosiery item directly on the machine used for its production, of not penalizing excessively the productivity of the machine.

The transfer of the hosiery item, or more generally of the tubular article, from the machine used for its production to the station in which an axial end of the article is to be closed, or more generally additional work on the article is to be done, is performed generally by means of a pick-up device which, by means of pick-up elements, individually takes the loops of knitting the article from the needles of the machine and retains them during the transfer of the article.

In some methods for closing the toe of hosiery items, the pick-up device is used also to support the article during the execution of the additional work, while in other methods the pick-up device is used exclusively to transfer the article, since once it has reached the station in which the additional work is to be performed, it transfers the loops of knitting, previously picked up by the needles, to another device which has the function of supporting the article during the execution of the additional work, such as for example a handling device. This handling device arranges the loops that belong to one half of the row of knitting received from the pick-up device so that they face the loops that belong to the other half of the same row of knitting and supports the two half-rows of knitting in a mutually facing position during the intervention of a sewing or linking head, which joins the mutually facing pairs of loops of knitting.

In some pick-up devices of the known type used to simply transfer the article from the machine that produces it to a handling device, the coupling between the pick-up elements and the needles, in order to transfer the loops of knitting from the needles to the pick-up elements, usually occurs by means of the insertion of the head of the needle in a seat formed in the end of the pick-up element. For this reason, the pick-up device usually has an annular pick-up body, which is designed to face coaxially the end of the needle cylinder from which the heads of the needles protrude and which supports a plurality of pick-up elements oriented parallel to the axis of the pick-up body.

A pick-up device of this kind is shown for example in EP0942086.

Pick-up devices are also known, and described for example in EP2250306, which comprise an annular pick-up body which supports pick-up elements which can slide along radial directions with respect to the pick-up body. The pick-up body can be arranged coaxially around the needle cylinder of a circular hosiery knitting machine so that each one of the pick-up elements faces laterally a corresponding needle of the machine.

This type of pick-up device comprises actuation means which act on the pick-up elements in order to move them toward or away from the axis of the pick-up body so as to engage or disengage each pick-up element with respect to the needle which it is made to face and each one of the pick-up elements is adapted to pick up the loop of knitting of the article retained on the needle.

According to EP2250306, the end of each one of the pick-up elements that is directed toward the axis has a seat, which can engage a region of the stem of the needle that is located proximate to the latch of the needle on the opposite side with respect to the head, and the actuation means comprise elastic means which act on the pick-up elements in order to cause their sliding toward the axis and radial pushers which act on the pick-up elements to cause their sliding away from the axis in contrast with the action of the elastic means.

In the additional work station there is a handling device which is provided with an annular body arranged so that its axis is vertical. The annular body is provided, on its lower face, with a plurality of spikes arranged along an imaginary cylindrical surface the axis of which coincides with the axis and which extend parallel to said axis. The spikes are angularly mutually spaced around the axis uniformly along according to an angular spacing that corresponds to the spacing that exists between the pick-up elements of the pick-up device. In practice, each pick-up element is matched by a spike of the handling device and when the pick-up device is arranged in the additional work station the pick-up body of the pick-up device assumes a position that is coaxial to the body of the handling device with the pick-up elements arranged around the annular arrangement of spikes and with each pick-up element in radial alignment with a spike.

SUMMARY OF THE INVENTION

The aim of the present invention is to solve the problems described above, providing a pick-up device for picking up a tubular knitted article from a circular knitting machine for hosiery or the like and for its transfer to a unit adapted to perform additional operations on the article that can be provided in a relatively simple manner and can be coupled to the needles of the machine with excellent precision.

Within this aim, an object of the invention is to provide a device that ensures high reliability in operation.

This aim, as well as this and other objects which will become better apparent hereinafter, are achieved by a pick-up device for picking up a tubular knitted article from a circular knitting machine for hosiery or the like and for its transfer to a unit adapted to perform additional operations on the article, according to the provisions of the independent claims.

BRIEF DESCRIPTION OF THE SEVERAL VIEWS OF THE INVENTION

Further characteristics and advantages of the invention will become better apparent from the description of a preferred but not exclusive embodiment of the pick-up device according to the invention, illustrated by way of nonlimiting example in the accompanying drawings, wherein:

FIG. 1 is a schematic axial sectional view of the pick-up device according to the invention with its pick-up body arranged above and coaxially with respect to the needle cylinder of a circular knitting machine for hosiery or the like;

FIG. 1*a* is an enlarged-scale view of a detail of FIG. 1;

FIG. 2 is an enlarged-scale schematic top plan view of the pick-up device in the position shown in FIG. 1, with some parts shown in phantom lines and in dashes;

FIG. 2*a* is an enlarged-scale view of a pick-up body;

FIG. 3 is a schematic axial sectional view of the pick-up device according to the invention with its pick-up body lowered onto the knitting 5 machine for hosiery or the like;

Figure 4:
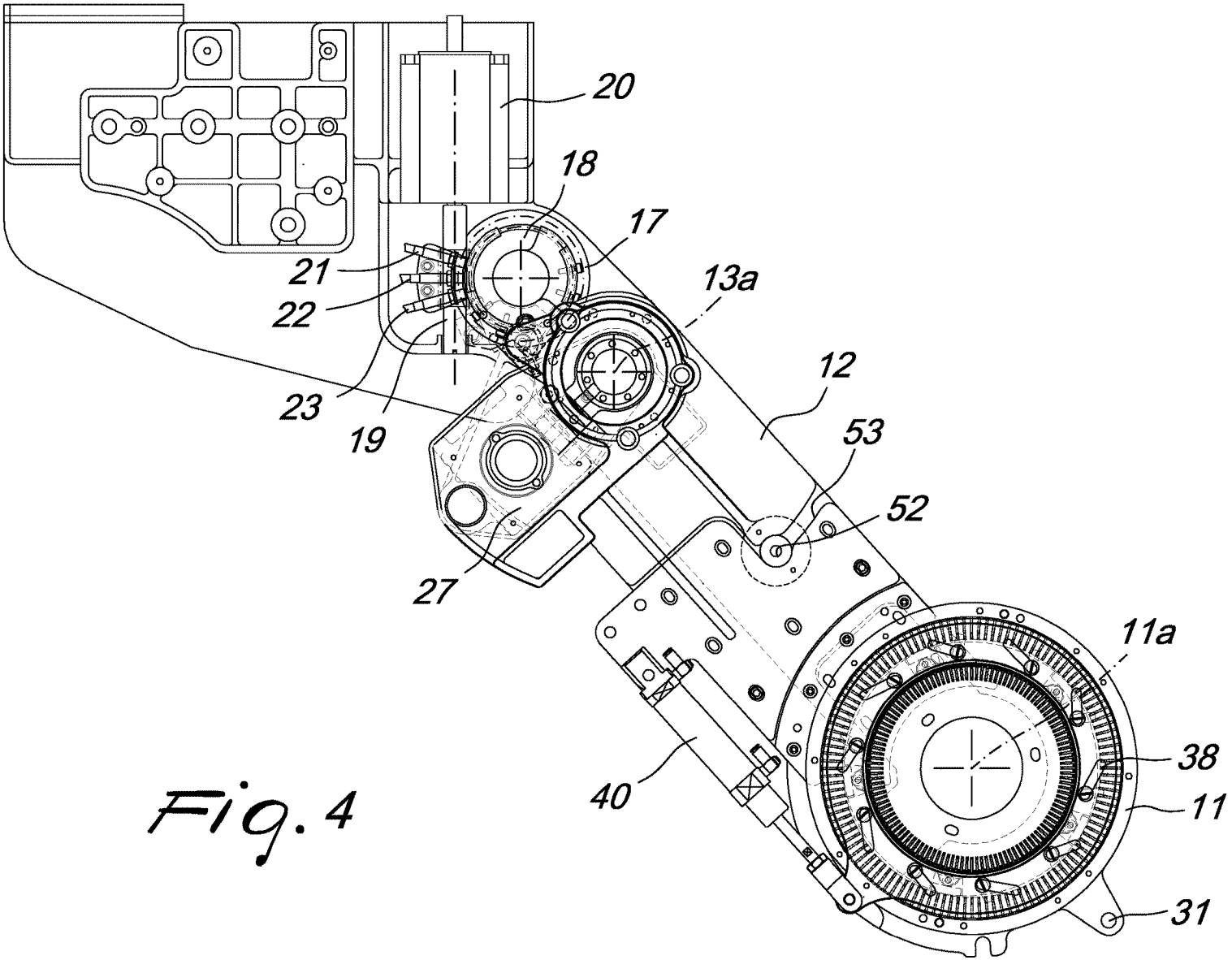
FIG. 4 is an enlarged-scale schematic top plan view of the pick-up device in the position shown in FIG. 3.
Figure 4A:
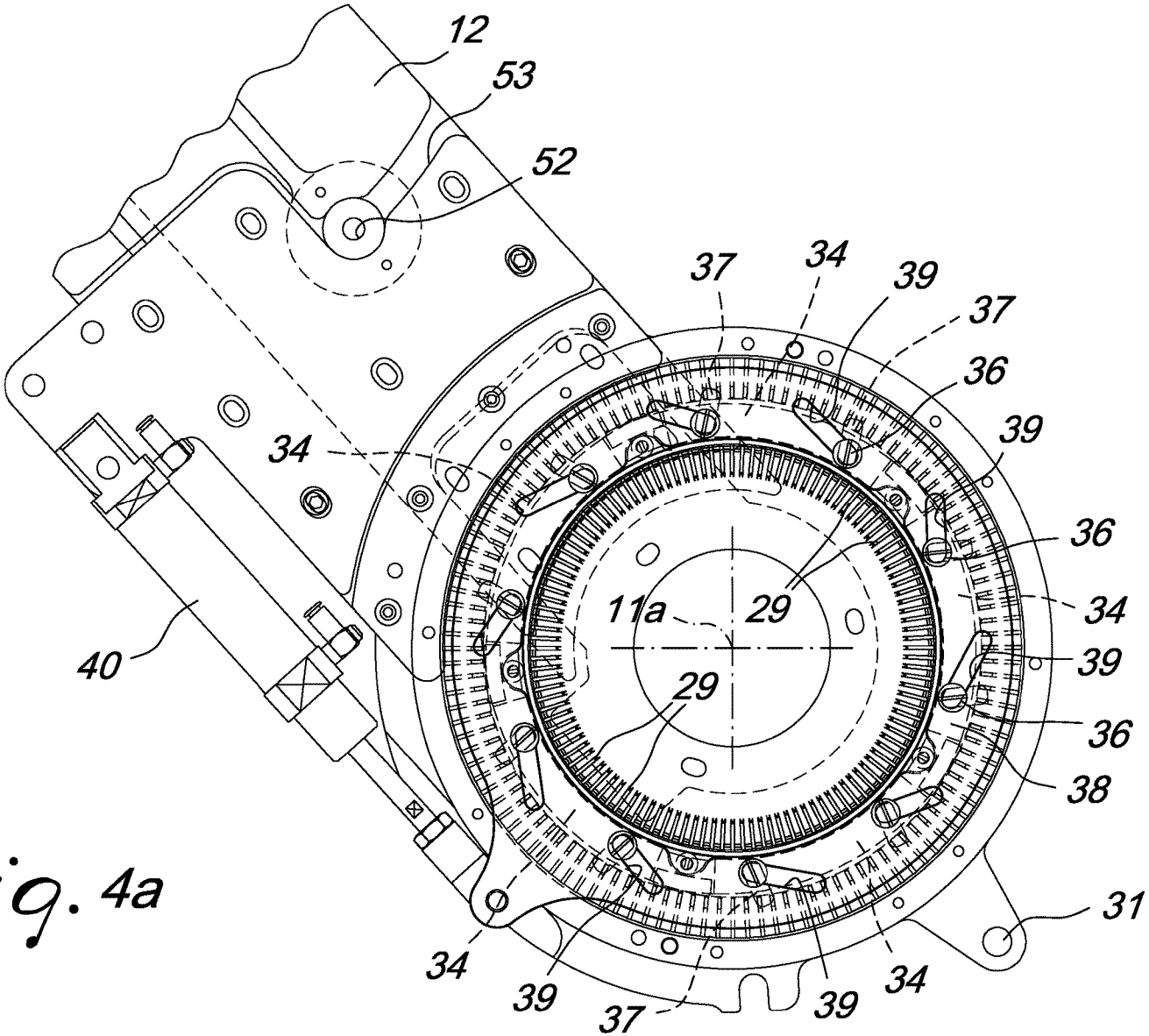
Figure 5:
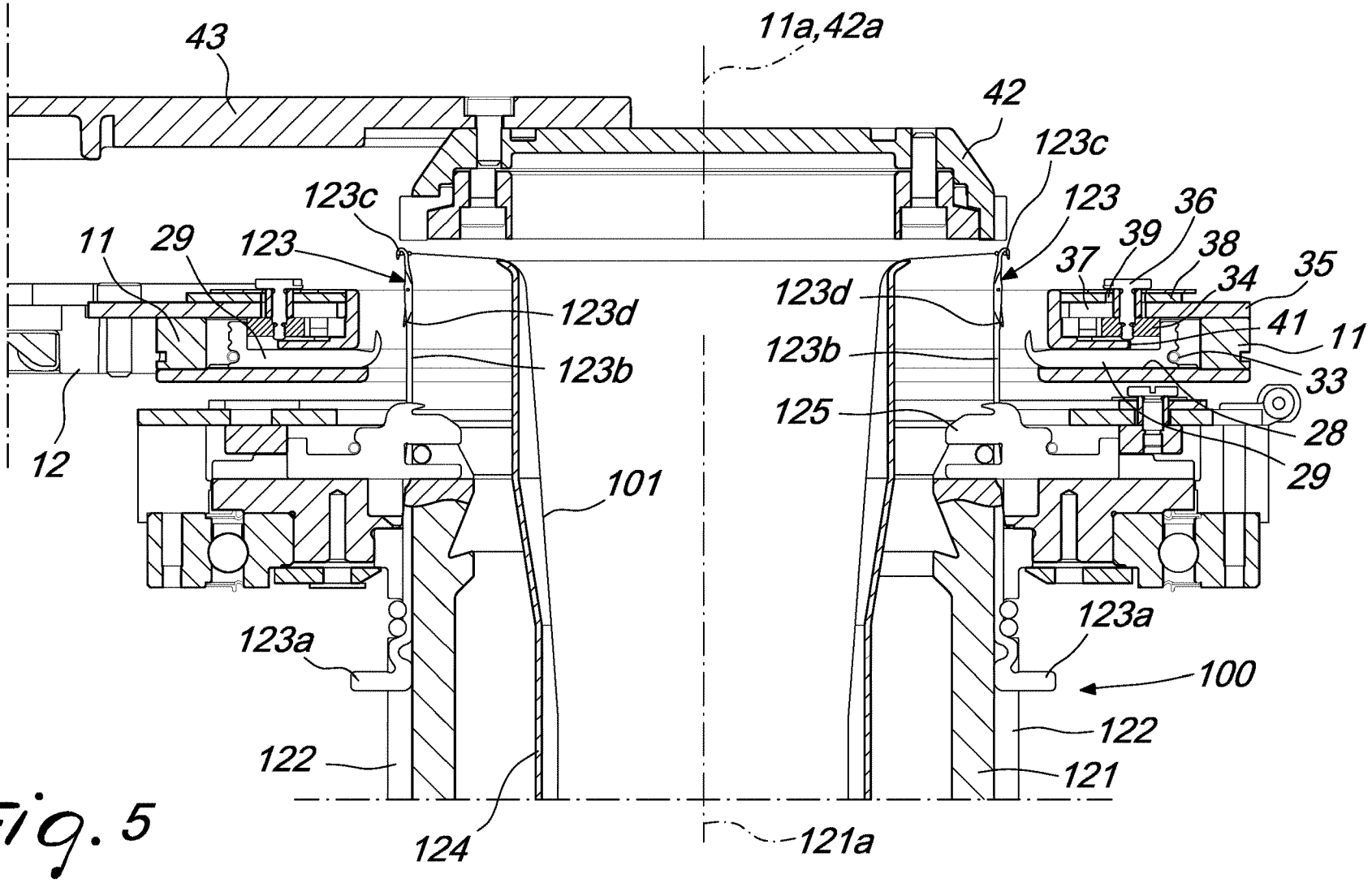
Figure 6:
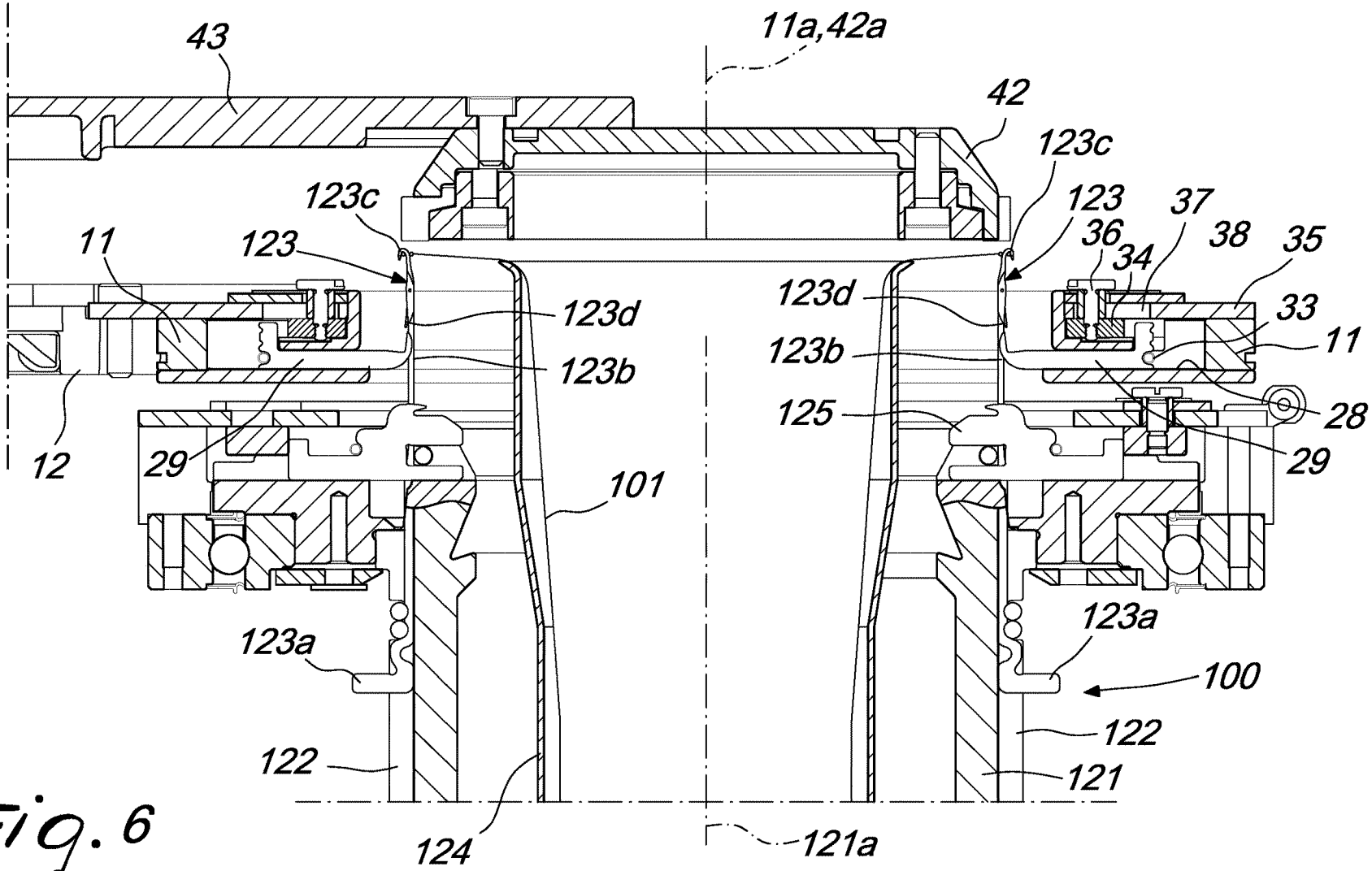
Figure 7:
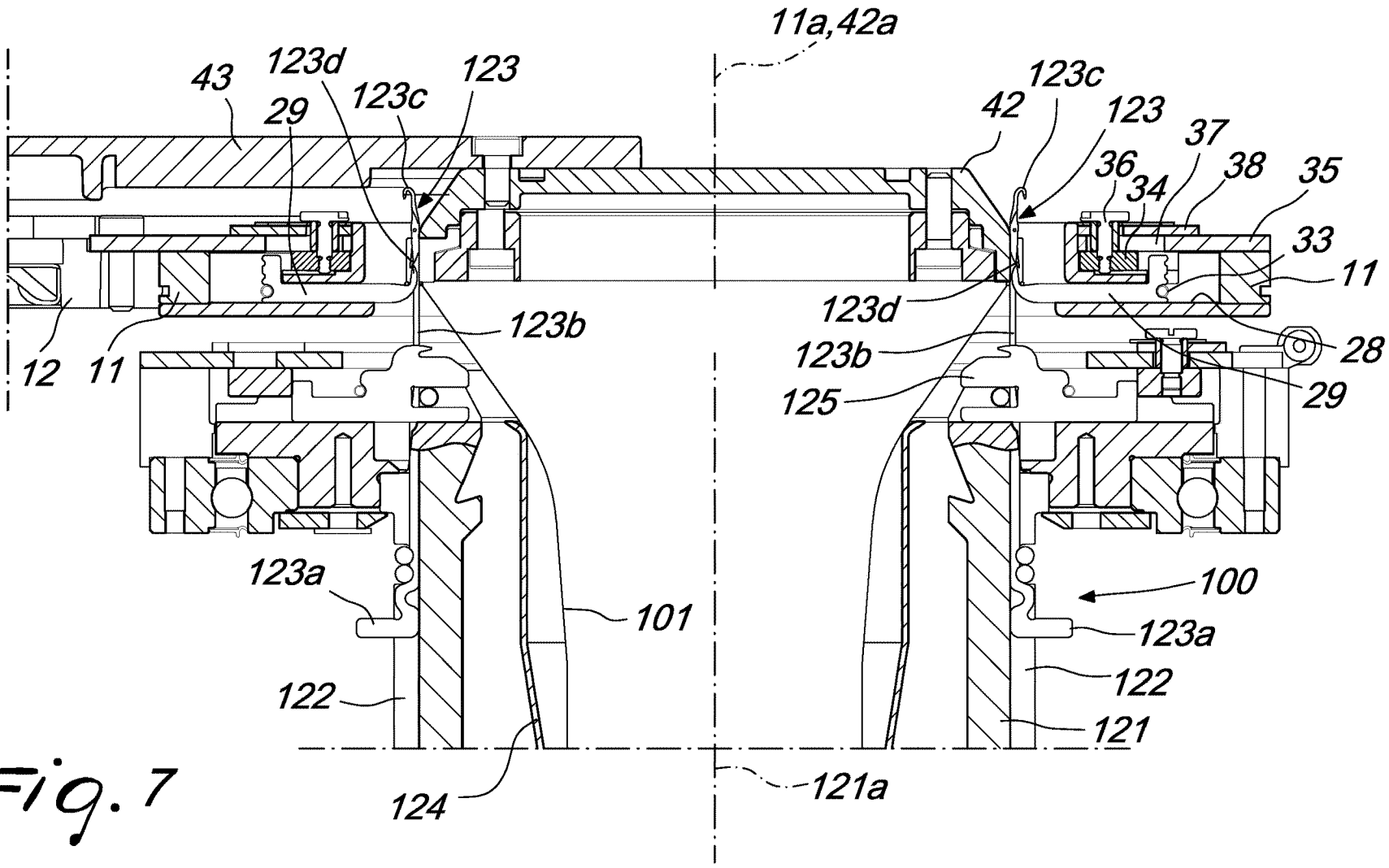
Figure 8:
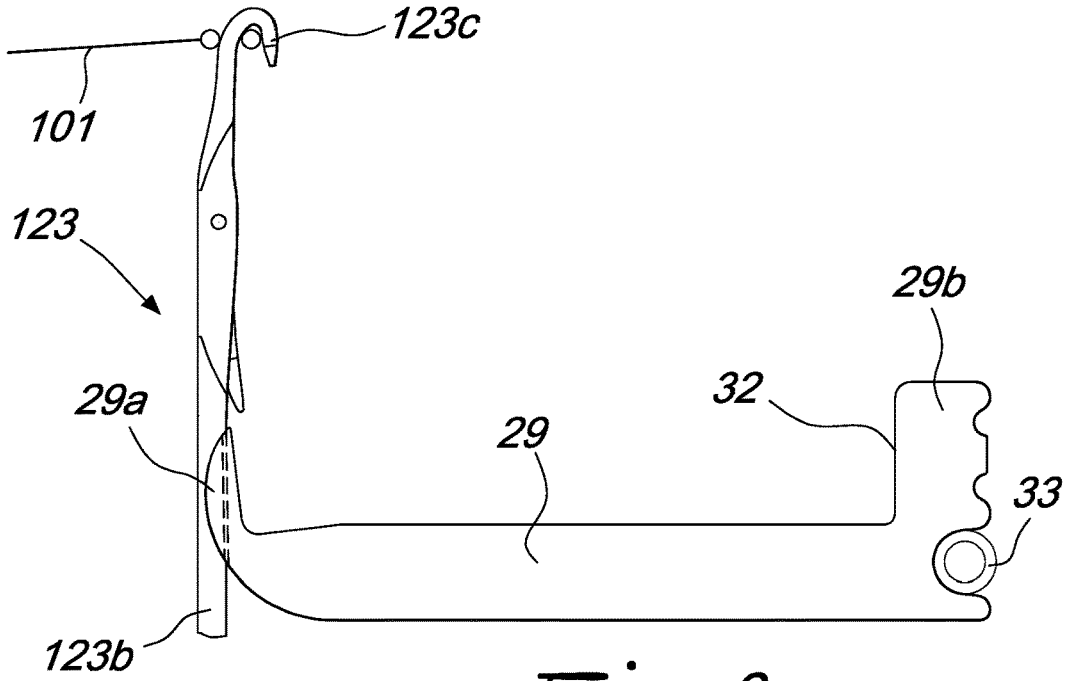
Figure 9:
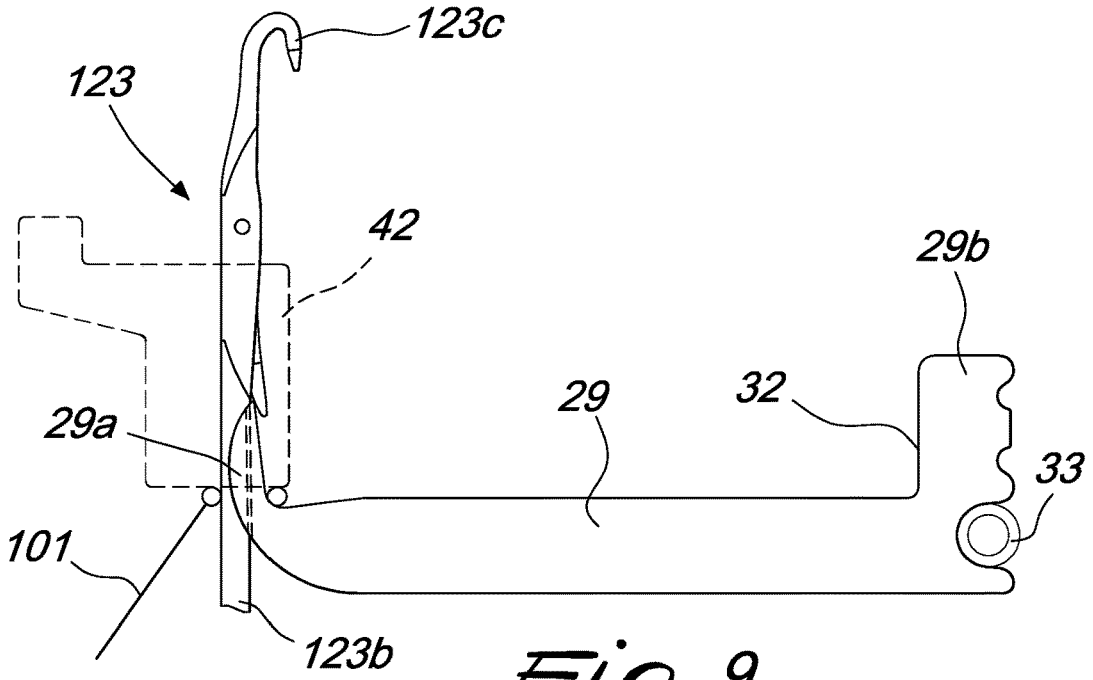
Figure 10:
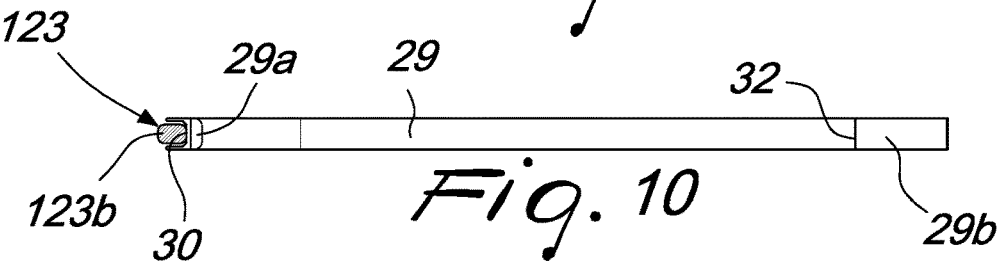
Figure 11:
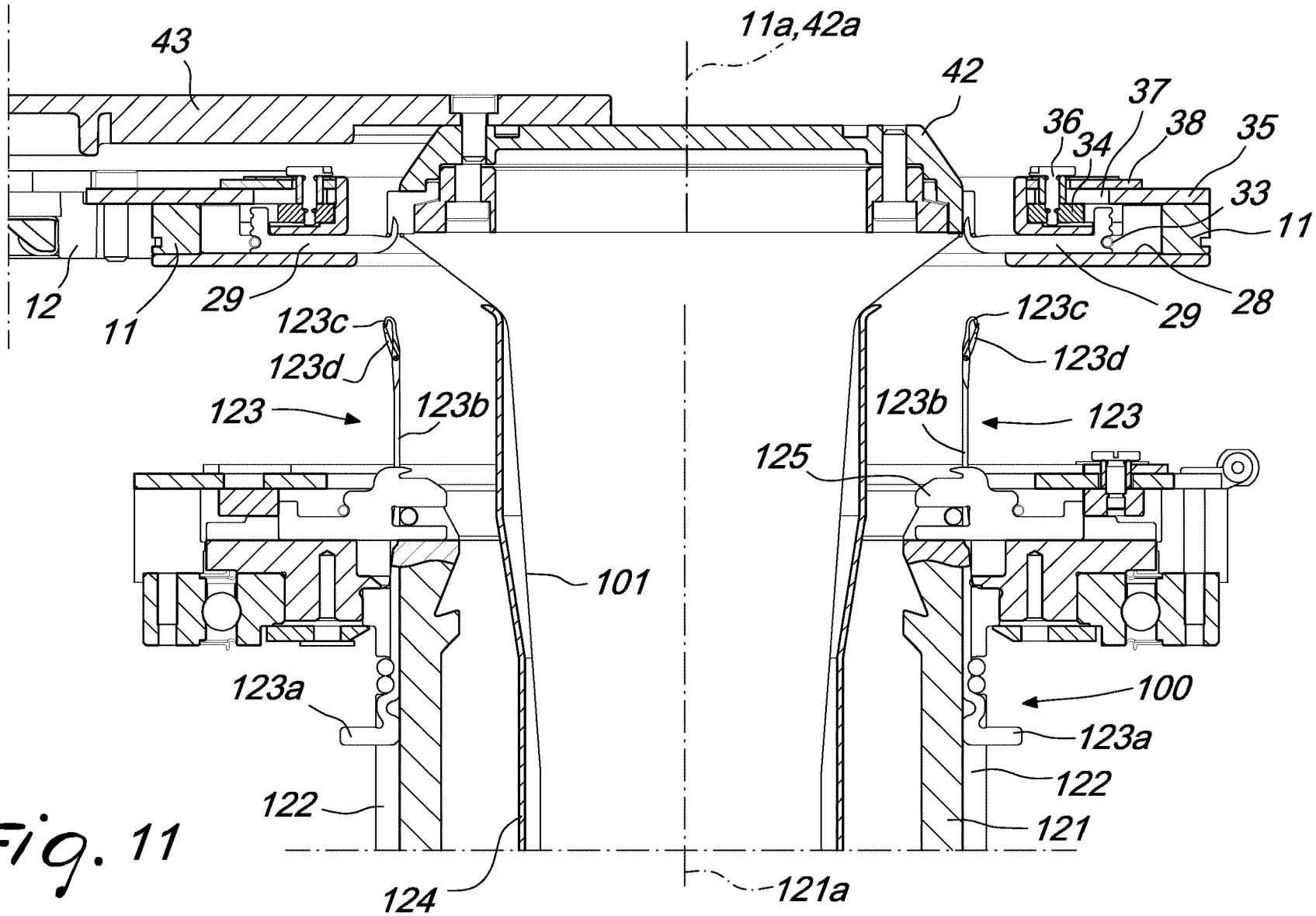
Figure 12:
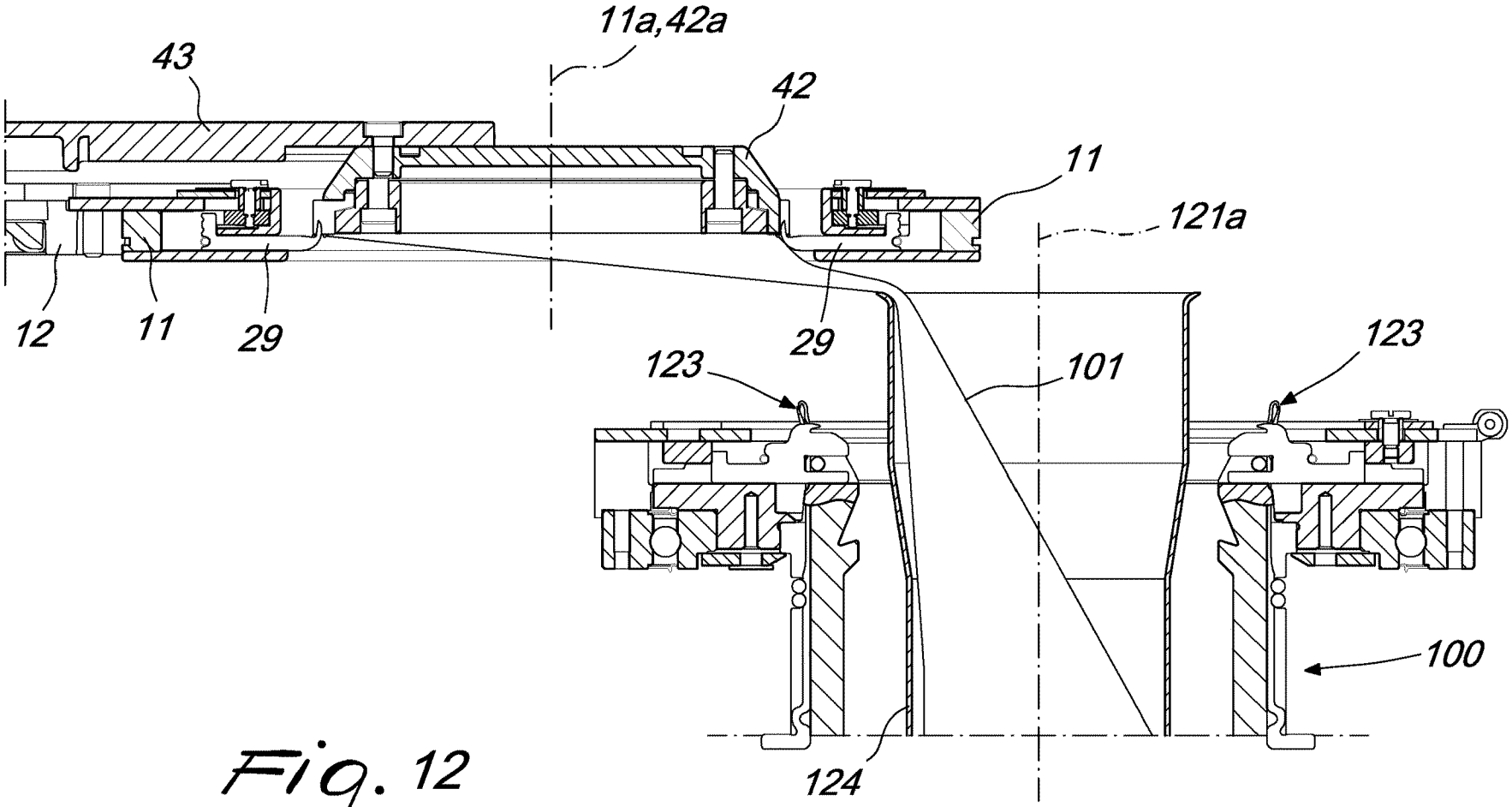
Figure 13:
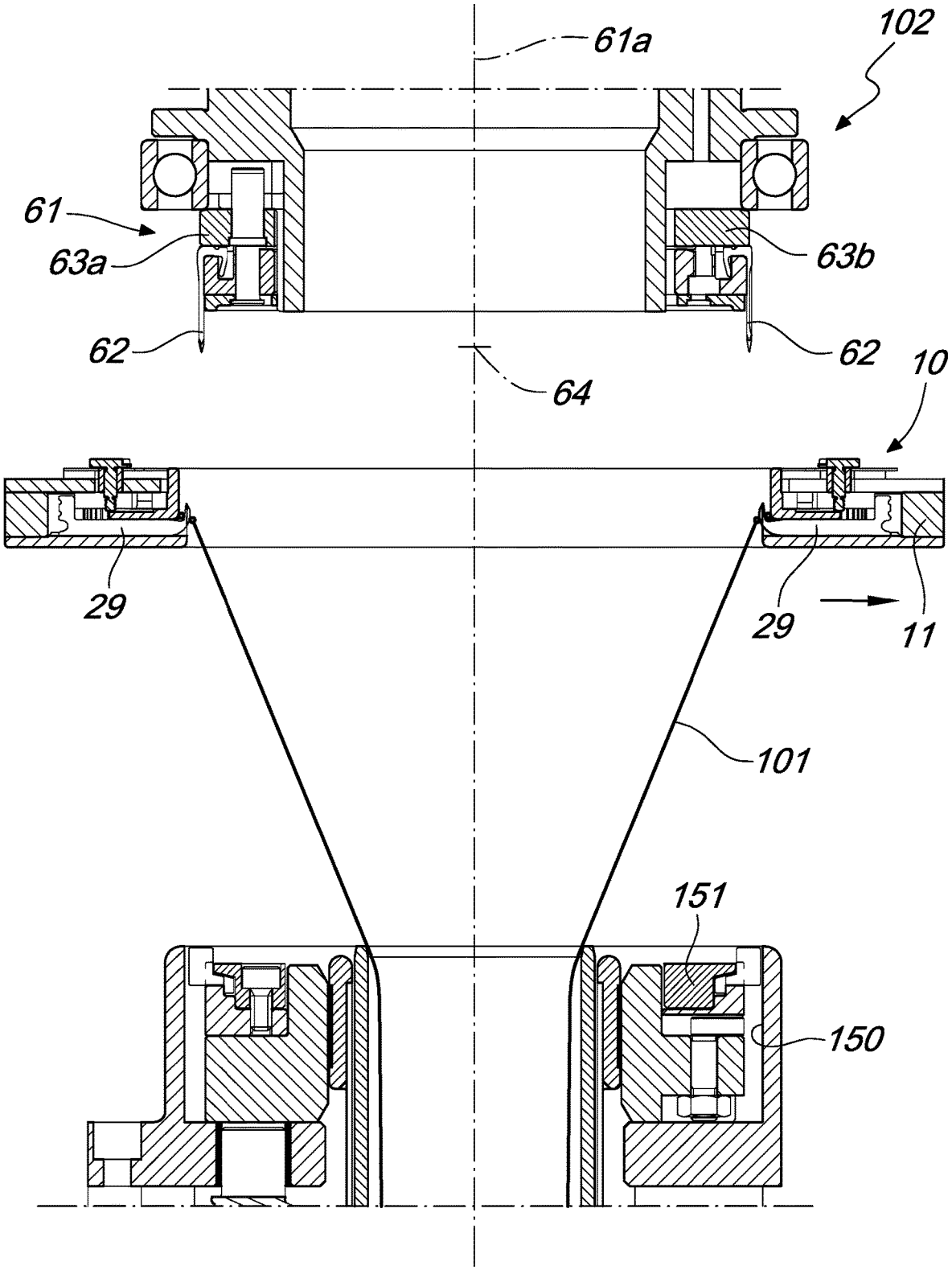
Figure 14:
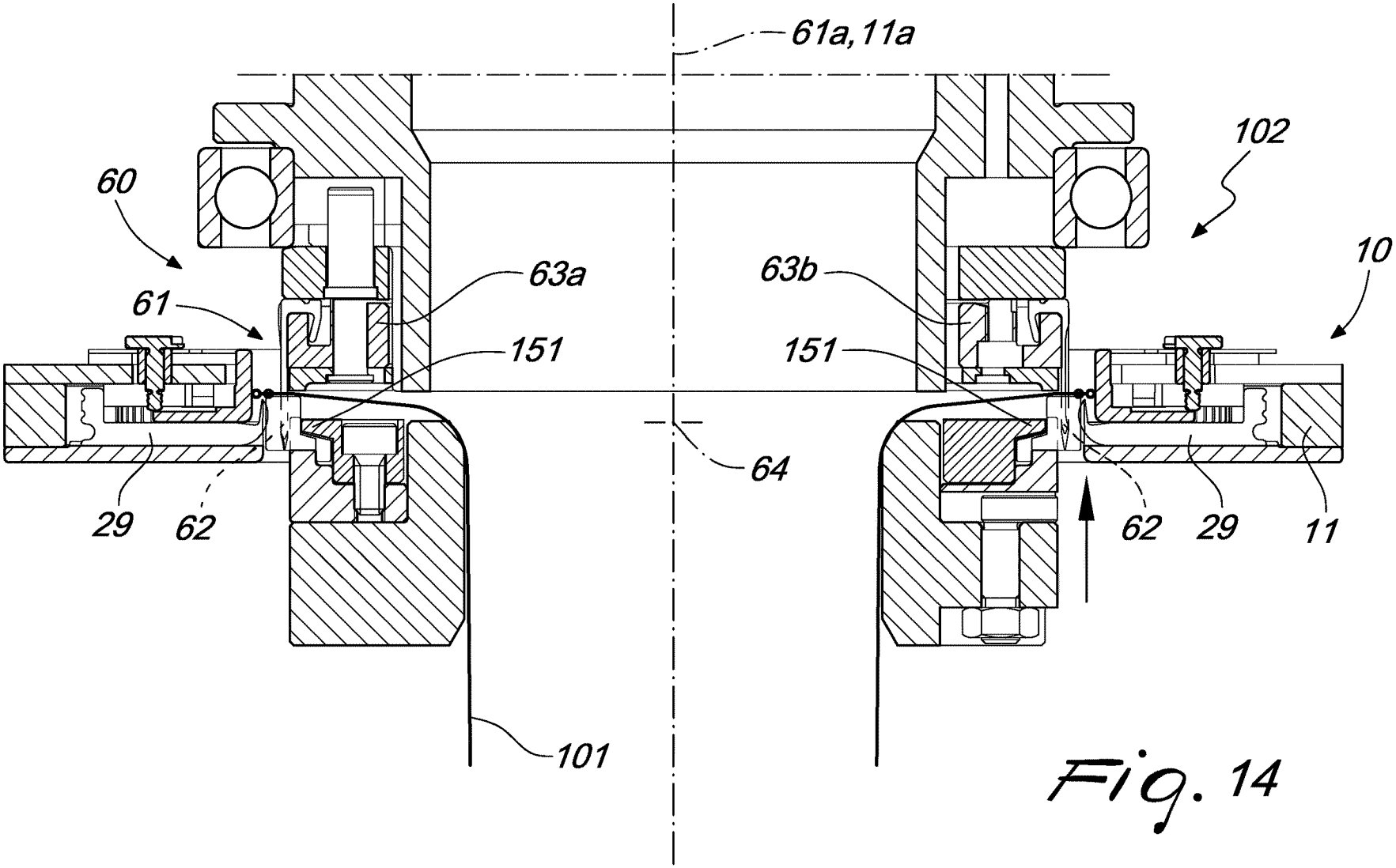
Figure 15:
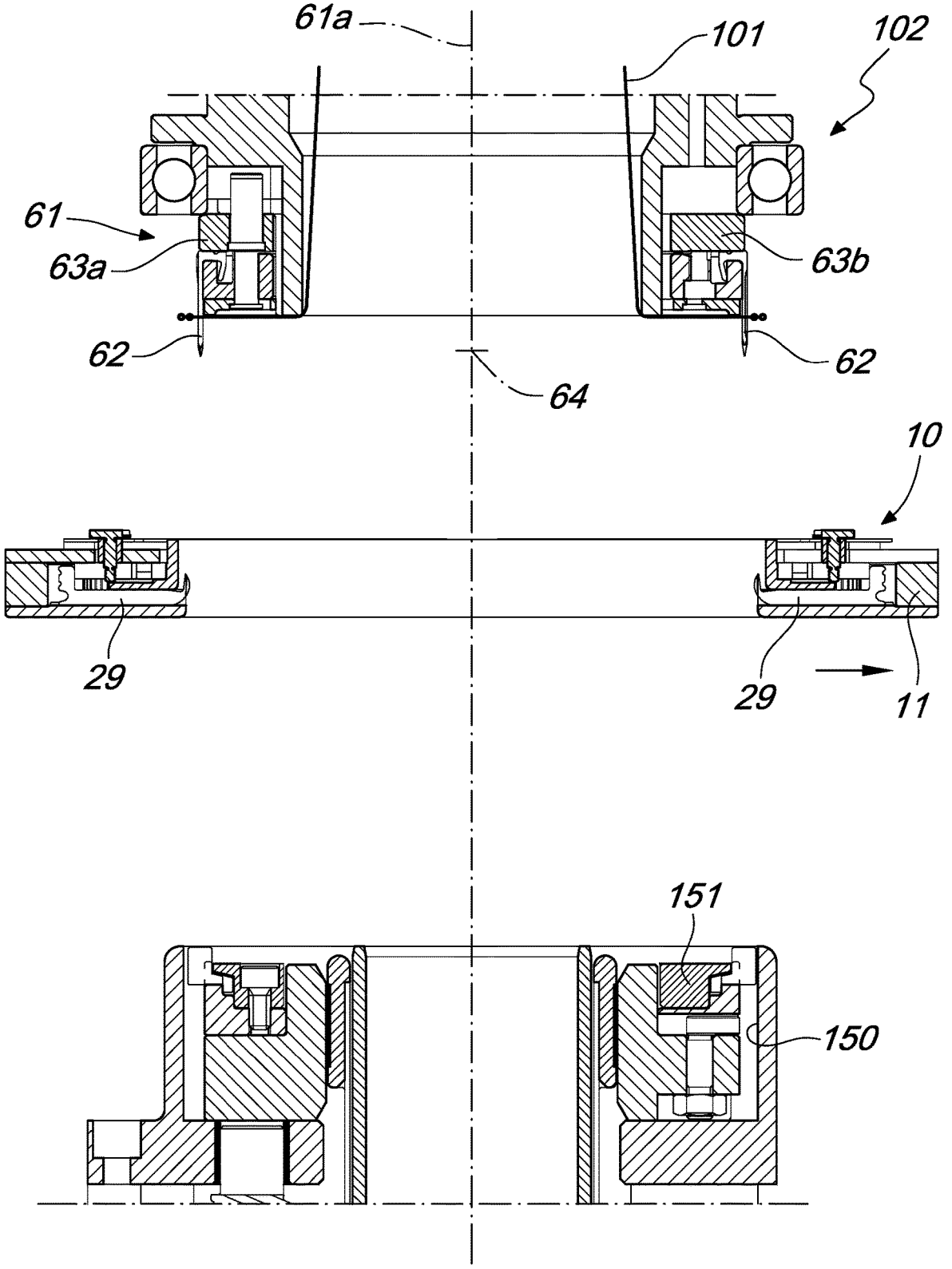

FIG. 4*a* is an enlarged-scale view of a detail of FIG. 4;

FIGS. 5 to 15 are schematic views of the operation of the pick-up device according to the invention during the pick-up of an article from the machine used for its production and of its arrangement in a station for additional work of the article, more particularly:

FIG. 5 is an axial sectional view of the pick-up body arranged around the needle cylinder of a machine used to produce the article before the engagement of the pick-up elements with the needles of the machine;

FIG. 6 is an axial sectional view, similar to FIG. 5, of the engagement of the pick-up elements with the needles of the machine;

FIG. 7 is an axial sectional view of the passage of the loops of knitting from the needles of the machine to the pick-up elements;

FIG. 8 is an enlarged-scale lateral elevation view of a pick-up element of the pick-up device according to the invention, rested against the stem of a needle;

FIG. 9 is an enlarged-scale lateral elevation view of a pick-up element of the pick-up device according to the invention, coupled to the stem of a needle, during the transition of a loop of knitting from the needle to the pick-up element;

FIG. 10 is an enlarged-scale top plan view of a pick-up element of the pick-up device according to the invention, coupled to the stem of a needle, in a transverse cross-section;

FIG. 11 is an axial sectional view of the disengagement of the article, by means of the pick-up body, from the needles of the machine used for its production;

FIG. 12 is an axial sectional view of the pick-up body during the removal of the article from the machine used for its production;

FIG. 13 is an axial sectional view of the arrangement of the pick-up body at a handling device arranged in the additional work station and spaced from the machine used for the production of the article;

FIG. 14 is an axial sectional view of the pick-up body located at the handling device during the transition of the article from the pick-up body to the handling device;

FIG. 15 is an axial sectional view of the spacing of the pick-up body from the station for additional work of the article after the article has been abandoned on the handling device.

DETAILED DESCRIPTION OF THE INVENTION

The device according to the invention is shown in its application to a single-cylinder knitting machine for hosiery or the like, generally designated by the reference numeral 100, but it can also be used to pick up an article 101 from the needles arranged in the lower needle cylinder of a double-cylinder circular knitting machine for hosiery or the like or also to pick up an article from the needles located in the upper needle cylinder of a double-cylinder circular knitting machine for hosiery or the like. In this last case, however, the device according to the invention must be installed upside down with respect to what is shown in the accompanying figures.

With reference to the figures, the single-cylinder circular knitting machine for hosiery or the like 100, designed to be served by the pick-up device according to the invention, comprises a needle cylinder 121, with a vertically oriented axis 121*a*. Multiple axial slots 122 are formed on the lateral surface of the needle cylinder 121 and a needle 123 is accommodated inside each one of them and can be actuated with an alternating motion along the corresponding axial slot 122 in order to form knitting.

In a per se known manner, inside the needle cylinder 121 there is a suction tube 124 which is coaxial to the needle cylinder 121. This suction tube 124, the upper end of which is open and goblet-shaped, can move along the axis 121*a* with respect to the needle cylinder 121 so that it can protrude, for a portion of its extension, from the upper end of the needle cylinder 121.

The needles 123 are actuated in a per se known manner, for example by means of cams, not shown for the sake of simplicity, which are arranged around the needle cylinder 121 and can engage, as a consequence of the rotation of the needle cylinder 121 about its own axis 121*a* with respect to said cams, with the heels 123*a* of the needles 123 that protrude radially from the lateral surface of the needle cylinder 121. The machine 100, being a machine substantially of a known type, is not described further for the sake of simplicity.

With reference to the figures, the pick-up device according to the invention, designated generally by the reference numeral 10, comprises a pick-up body 11, which is annular and supports pick-up elements 29 which can slide, with respect to the pick-up body 11, along radial directions. The pick-up body 11 can be arranged coaxially around the needle cylinder 121 of a circular hosiery knitting machine 100 so that each one of the pick-up elements 29 faces laterally a corresponding needle 123 of the machine 100.

The pick-up device 10 comprises actuation means which act on the pick-up elements 29 in order to move them toward or away from the axis 11*a* of the pick-up body 11 so as to actuate the engagement or disengagement of each pick-up element 29 with respect to the needle 123 which it is made to face and each one of the pick-up elements 29 is adapted to pick up the loop of knitting of the article 101 retained on the needle 123, as will become better apparent hereinafter.

The end 29*a* of each one of the pick-up elements 29 that is directed toward the axis 11*a* has a seat 30 which can engage a region of the stem 123*b* of the needle 123 that is located proximate to the latch 123*d* of the needle 123 on the opposite side with respect to the head 123*c*, and the actuation means comprise elastic means which act on the pick-up elements 29 to cause their sliding towards the axis 11*a* and radial pushers 34 which act on the pick-up elements 29 to produce their sliding away from the axis 11*a* in contrast with the action of the elastic means.

More particularly, the pick-up body 11 is arranged so that its axis 11*a* is vertical and is fixed to the end of an arm 12, which is arranged horizontally and is connected, with its opposite end, to a sleeve 13 which has a vertical axis 13*a*. The sleeve 13 is fitted coaxially around a hollow shaft 14 and is integral therewith in rotation about its axis 13*a*. The hollow shaft 14 is supported, so that it can rotate about its own axis 13*a*, by a supporting structure 15 which can be constituted by the supporting structure of the machine 100 or by an autonomous supporting structure which optionally can be associated with the supporting structure of the machine 100.

A gear 16 is keyed on the hollow shaft 14 and meshes with a gear 17 which is coaxial and integral with a helical gear 18 which mates with a worm gear 19 that is fixed to the output shaft of an electric motor 20 supported by the supporting structure 15.

Essentially, the actuation of the electric motor 20 causes the rotation of the arm 12 about the axis 13*a*, which constitutes a vertical actuation axis for the arm 12 with respect to the supporting structure 15, producing the transition of the pick-up body 11 from a pick-up position, in which it is arranged coaxially to the needle cylinder 121 of the machine 100, to a release position, in which it is arranged at an additional work station 102, constituted for example by a sewing or linking station, and vice versa, in which the unit adapted to perform additional work on the article 101 is arranged, as will become better apparent hereinafter.

Preferably, it is possible to stop the rotation of the arm 12 in a standby or intermediate position which is located between the pick-up position and the release position cited above.

The three positions, which can be assumed by the pick-up body 11 following the actuation of the electric motor 20, are controlled by three sensors 21, 22 and 23, which detect references located on the block that supports the gear 17 and the helical gear 18.

The station 102 for additional work of the article 101 comprises in particular a handling element 60 which has a plurality of spikes 62 arranged along a cylindrical surface and designed to engage the article 101.

According to the invention, the pick-up body 11, in the release position, is arranged coaxially to the cylindrical surface along which the spikes 62 are arranged.

The cylindrical surface along which the spikes 62 are arranged is spaced radially in the direction of the axis 11*a* of the pick-up body 11 with respect to the cylindrical surface along which the ends of the pick-up elements 29 directed toward the axis 11*a*, with the pick-up body 11 in the release position, are arranged.

The handling device 60 is provided with an annular body 61 which is arranged so that its axis 61*a* is vertical. The body 61 is provided, on its lower face, with the plurality of spikes 62, which are arranged along an imaginary cylindrical surface the axis of which coincides with the axis 61*a* and which extend parallel to said axis 61*a*. The spikes 62 are mutually angularly spaced uniformly around the axis 61*a*.

The angular spacing may correspond to the one that exists between the pick-up elements 29 of the pick-up device 10, but nothing forbids it from being also different, providing furthermore a different number of spikes 62 (preferably a smaller one) with respect to the number of the pick-up elements 29.

When the pick-up device 10 is positioned in the additional work station 102, the pick-up body 11 of the pick-up device 10 is located in a position that is coaxial to the body 61 of the handling device 60 with the pick-up elements 29 arranged around and externally with respect to the ring of spikes 62.

The sleeve 13, with the arm 12 connected thereto, can move on command along the axis 13*a* with respect to the hollow shaft 14. More particularly, the sleeve 13 is integral with a female thread 24 which has a vertical axis and with which a threaded shaft 25 mates and is connected, by means of a coupling 26, to the output shaft of an electric motor 27 which is supported by a block that is fixed to the hollow shaft 14.

In this manner, an actuation of the electric motor 27 causes the lifting or lowering of the arm 12 in any angular position of the arm 12 about the axis 13*a*.

The pick-up body 11 of the pick-up device 10 has a plurality of radial slots 28 inside each of which a pick-up element 29 is accommodated slidingly.

Each pick-up element 29, as shown in particular in FIGS. 8, 9 and 10, is provided with a laminar body which is arranged on a plane which is radial with respect to the axis 11*a* of the pick-up body 11. The end of each pick-up element 29 that is directed toward the axis 11*a* is provided with a seat 30, which is open both toward the axis 11*a* and parallel to said axis 11*a*, i.e., both above and below. This seat 30, when the pick-up body 11 is in the pick-up position, can be coupled to the stem 123*b* of a needle 123 which the pick-up element 29 faces.

More particularly, the pick-up body 11 of the pick-up device 10 supports a number of pick-up elements 29 that matches the number of the needles 123 of the machine 100 and said pick-up elements 29 are angularly spaced around the axis 11*a* of the pick-up body 11 in a manner that corresponds to the angular spacing, around the axis 121*a* of the needle cylinder 121, that exists between the needles 123 of the machine 100. Furthermore, the pick-up body 11, in a peripheral region, supports a centering pin 31, which has a vertical axis and which, by means of the lowering of the arm 12, which can be actuated by means of the electric motor 27, can be inserted in a corresponding centering seat provided in the supporting structure of the machine 100 laterally to the needle cylinder 121 and not shown for the sake of simplicity. The coupling between the centering pin 31 and the corresponding centering seat ensures the precise positioning of the pick-up body 11 and of the pick-up elements 29 with respect to the needle cylinder 121 of the machine 100. Adapted control elements, usually provided in modern circular knitting machines for hosiery or the like, allow precise angular positioning of the needle cylinder 121 about its own axis 121*a* with respect to the supporting structure of the machine and therefore allowed to position each needle 123 of the machine in radial alignment with the seat 30 of a corresponding pick-up element 29 when required.

The centering pin 31 can be disengaged from the corresponding centering seat by lifting the arm 12 in order to allow the rotation of the arm 12 about the axis 13*a*.

Each pick-up element 29 rests, with one of its sides, on the bottom of a corresponding radial slot 28 and protrudes from it, in the direction of the axis 11*a*, with its end in which the seat 30 is formed. It should be noted that the seat 30 can be delimited laterally by two mutually opposite walls, as in the illustrated embodiment, but it can also be delimited only on one side by a single wall.

Preferably, the end 29*a* of each pick-up element 29 is shaped like a hook which is open upward and the seat 30 is formed on the back of the hook.

The end 29*b*, arranged opposite the end 29*a*, of each pick-up element 29 is shaped like a heel which extends parallel to the axis 11*a* and protrudes above the corresponding radial slot 28 of the pick-up body 11, so as to form a shoulder 32 that is directed toward the axis 11*a*. The elastic means which push the elements 29 toward the axis 11*a* act against the side of this heel that is directed opposite with respect to the axis 11*a*. Said elastic means are preferably constituted by an annular helical spring 33 the axis of which coincides with the axis 11*a* and which is arranged around the pick-up elements 29 and acts on the side of the end 29*b*, which is heel-shaped, that is opposite with respect to the shoulder 32.

The radial pushers 34 are arranged in the pick-up body 11 and act on command on the shoulder 32 so as to cause the sliding of the pick-up elements 29 away from the axis 11*a* in contrast with the action of the helical spring 33.

More particularly, the pick-up body 11 is closed in an upper region by a fixed plate 35 which is annular and is arranged concentrically to the axis 11*a*. Five radial pushers 34 are arranged inside the pick-up body 11, are shaped like annular sectors and face the shoulder 32 of the pick-up elements 29. Each one of these radial pushers 34 is fixed to a pair of pins 36, which are mutually angularly spaced around the axis 11*a* and are oriented parallel to the axis 11*a*. These pins 36 pass slidingly through first slits 37 which are formed in the fixed plate 35. The pairs of first slits 37 with which the pins 36 of a same radial pusher 34 engage are mutually parallel and are oriented so as to allow the corresponding radial pusher 34 to move radially toward and away from the axis 11*a*. A movable plate 38 is arranged above the fixed plate 35, is also annular, is arranged concentrically to the axis 11*a* and is supported, so that it can rotate about the same axis 11*a*, by the pick-up body 11. The movable plate 38 is crossed by second slits 39, one for each pin 36, which are each crossed slidingly by a pin 36. The second slits 39 are inclined with respect to the first slits 37 so that a rotation of the movable plate 38 about the axis 11*a* with respect to the pick-up body 11 and the fixed plate 35 causes a movement of the radial pushers 34 toward or away from the axis 11*a*.

The movable plate 38 is connected to a linear actuator which is provided with stroke adjustment means.

Preferably, the linear actuator comprises the stem of the piston of a double-acting fluid-operated cylinder 40 which is mounted on the arm 12 and can be actuated to cause the rotation of the movable plate 38 about the axis 11*a* with respect to the pick-up body 11.

Figure 2:
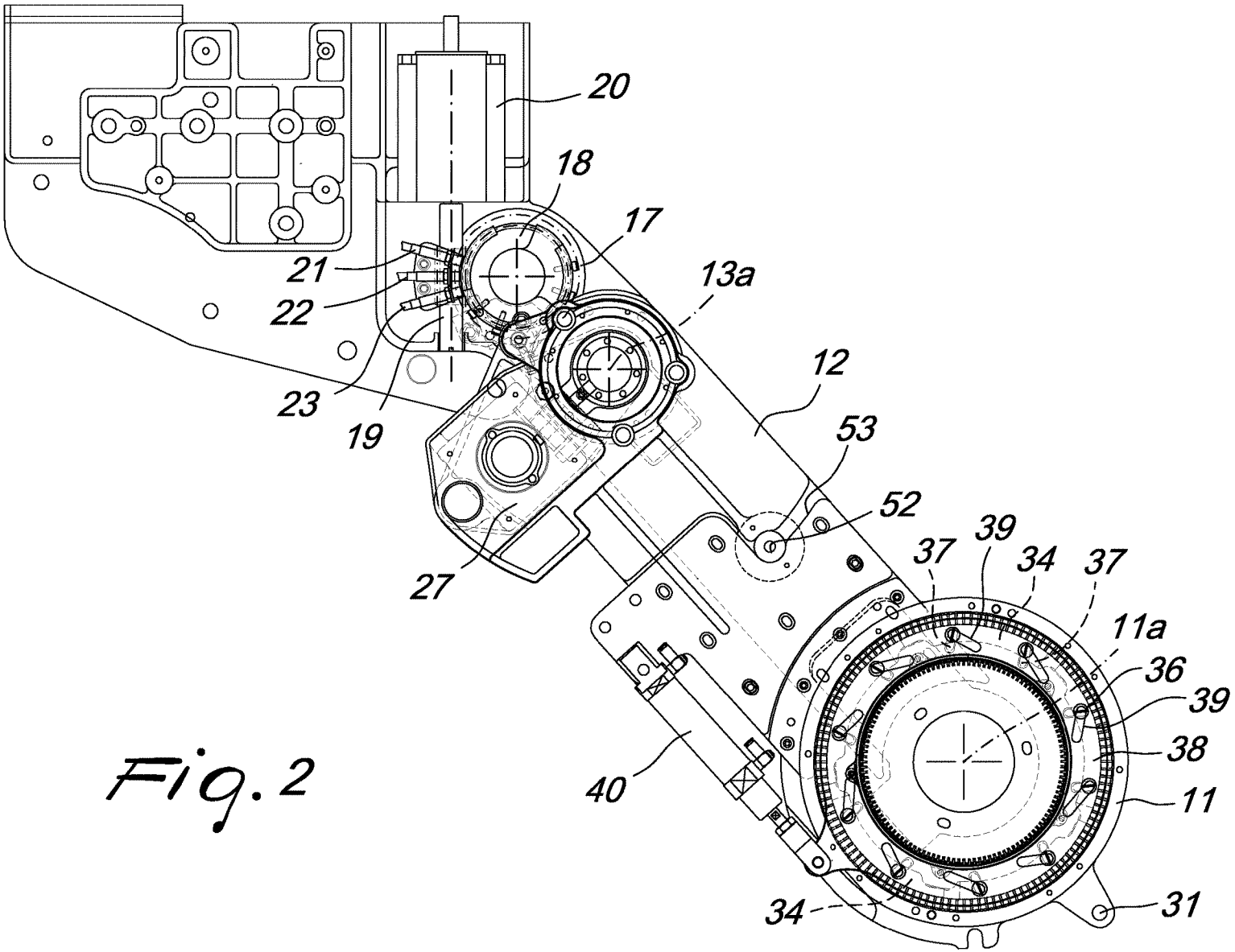
Figure 2A:
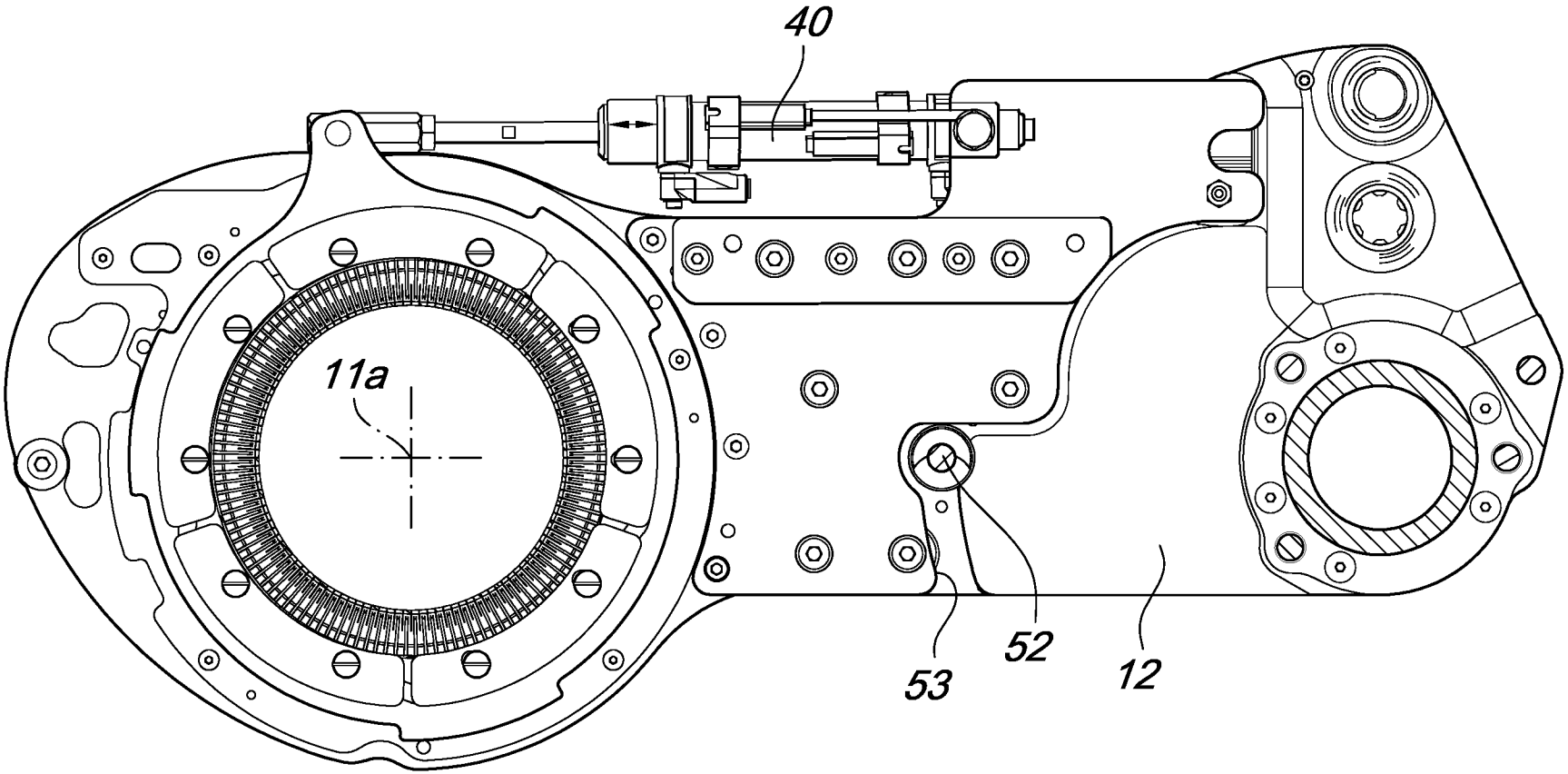

In practice, the actuation of the fluid-operated cylinder 40 causes the rotation of the movable plate 38 about the axis 11*a* with respect to the pick-up body 11 in one direction, producing the spacing of the radial pushers 34 and therefore of the pick-up elements 29 from the axis 11*a* in contrast with the action of the helical spring 33, as shown in particular in FIGS. 2, 2*a*, or in the opposite direction, producing the approach of the radial pushers 34 to the axis 11*a*, allowing the movement of the pick-up elements 29 toward said axis 11*a* by virtue of the action of the helical spring 33, as shown in particular in FIGS. 4, 4*a*. The stroke of the pick-up elements 29 toward the axis 11*a* is delimited by a shoulder 41 which is arranged opposite the shoulder 32 and is formed inside the pick-up body 11 or by the radial pushers 34.

It should be noted that each pick-up element 29 engages the stem 123*b* of the corresponding needle 123 by virtue of the action of the spring 33. As a consequence of this fact, a sort of adaptation of the stroke of each pick-up element 29 in the direction of the axis 11*a* to the actual radial position of the corresponding needle 123 is achieved. In practice, the particular actuation of the pick-up elements 29 makes the coupling of each pick-up element 29 to the corresponding needle 123 less critical, since it can obviate imprecise radial placements of the needles 123, thus ensuring in any case a precise mating. Furthermore, the particular actuation of the pick-up elements 29, in addition to allowing excellent containment of the axial space occupation of the pick-up body 11 as a whole, also allows to use a same pick-up device 10 with machines that have the same number of needles but are arranged along cylindrical surfaces that have slightly different diameters.

The pick-up device 10 also comprises a presser 42, which has a circular planar shape with a perimetric profile that is shaped like a comb with a plurality of teeth arranged around the axis 42*a*, which is oriented vertically, of the presser 42.

The presser 42 is connected to one end of a corresponding arm 43 which, in the illustrated embodiment, is arranged above the arm 12. The arm 43 is connected, with its opposite end, to a corresponding sleeve 44 which is arranged coaxially to the sleeve 13 and mates, so as to be able to rotate about the axis 13*a* and so as to be able to slide along said axis 13*a*, in a cylindrical seat 45 formed in the sleeve 13.

The arm 43 rests against the upper end of posts 46 which have a vertical axis, are arranged around the axis 13*a* and are accommodated, so that they can slide axially, in corresponding seats 47 formed by the sleeve 13. The arm 43 rests on the posts 46 by means of a bearing 48, the axis of which coincides with the axis 13*a* so as to reduce the sliding of the arm 43 on the posts 46 during a rotation of the arm 43 with respect to the arm 12 about the axis 13*a*.

The posts 46 are pushed in the direction of the arm 43, and therefore upward in the illustrated embodiment, by springs 49 which are interposed between the posts 46 and the corresponding seats 47.

The sleeve 13 supports a fluid-operated cylinder 50, which has a vertical axis and rests with the stem of its piston against the sleeve 44. In practice, the fluid-operated cylinder 50 is integral with the sleeve 13 in rotation about the axis 13*a* and in translation along said axis 13*a* and can be actuated in order to produce the translation, downward in the illustrated embodiment, of the sleeve 44 and therefore of the arm 43 along the axis 13*a* with respect to the arm 12 in contrast with the action of the springs 49.

The arm 43, on its side directed toward the arm 12, is provided with a pin 51 which has a vertical axis and which, by means of the translation of the arm 43 with respect to the arm 12 along the axis 13*a*, can be inserted in a seat 52 having a vertical axis which is formed in the arm 12 or can be extracted from said seat 52.

The coupling of the pin 51 to the seat 52 ensures the coaxial arrangement of the presser 42 with respect to the pick-up body 11 and at the same time renders mutually integral the arm 12 and the arm 43 and therefore the presser 42 and the pick-up body 11 in rotation about the axis 13*a*.

Figure 3:
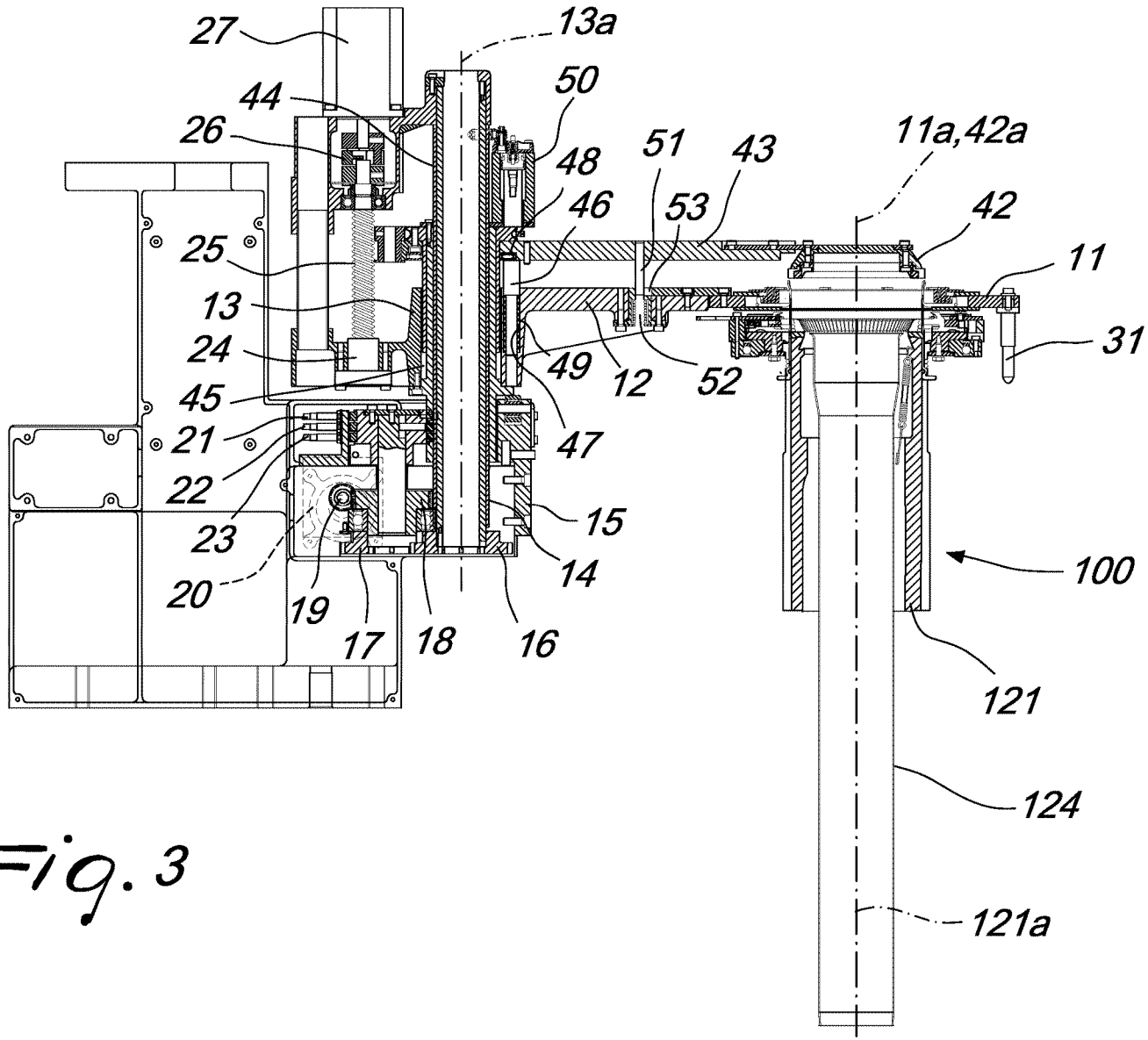

The inlet of the seat 52 is formed on the bottom and at a closed end of a slot 53 which is formed on the face of the arm 12 that is directed toward the arm 43. This slot 53 is shaped like a circular sector that is centered on the axis 13*a* and is open at one of its ends that is opposite with respect to the end occupied by the seat 52. In the condition of maximum spacing of the arm 43 above the arm 12, the lower end of the pin 51 is at such a level as to disengage from the seat 52 but be able to engage with the slot 53, as shown for example in FIGS. 1 and 3. In this manner, in the condition of maximum spacing of the arm 43 above the arm 12, the arm 12 can rotate about the axis 13*a* with respect to the supporting structure 15, disengaging from the arm 43 in one direction since the pin 51 exits from the open end of the slot 53 while in rotation in the opposite direction it engages the arm 43, since the pin 51 enters said open end of the slot 53, engaging therewith, as will become better apparent hereinafter.

Figure 1:
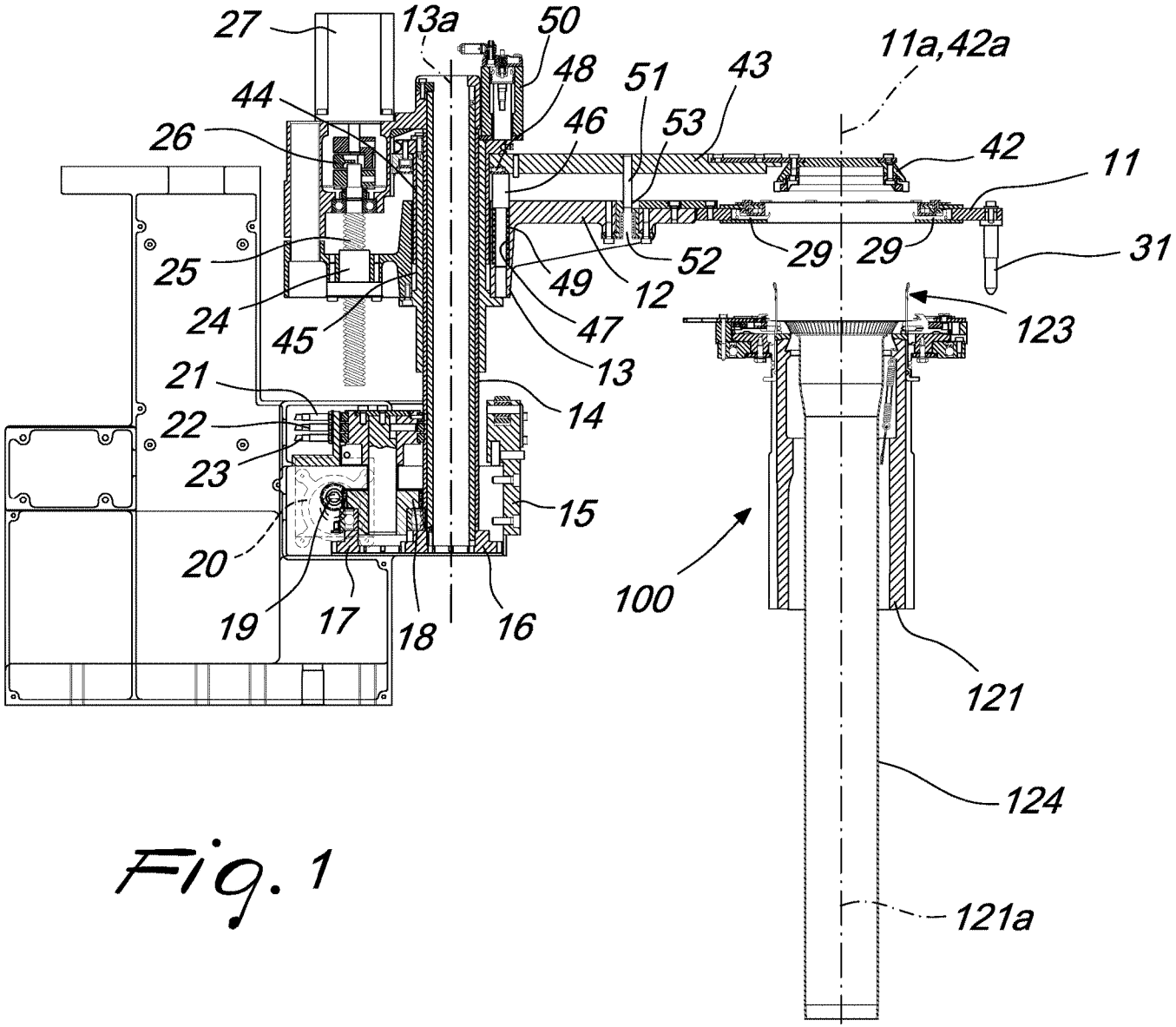
Figure 1A:
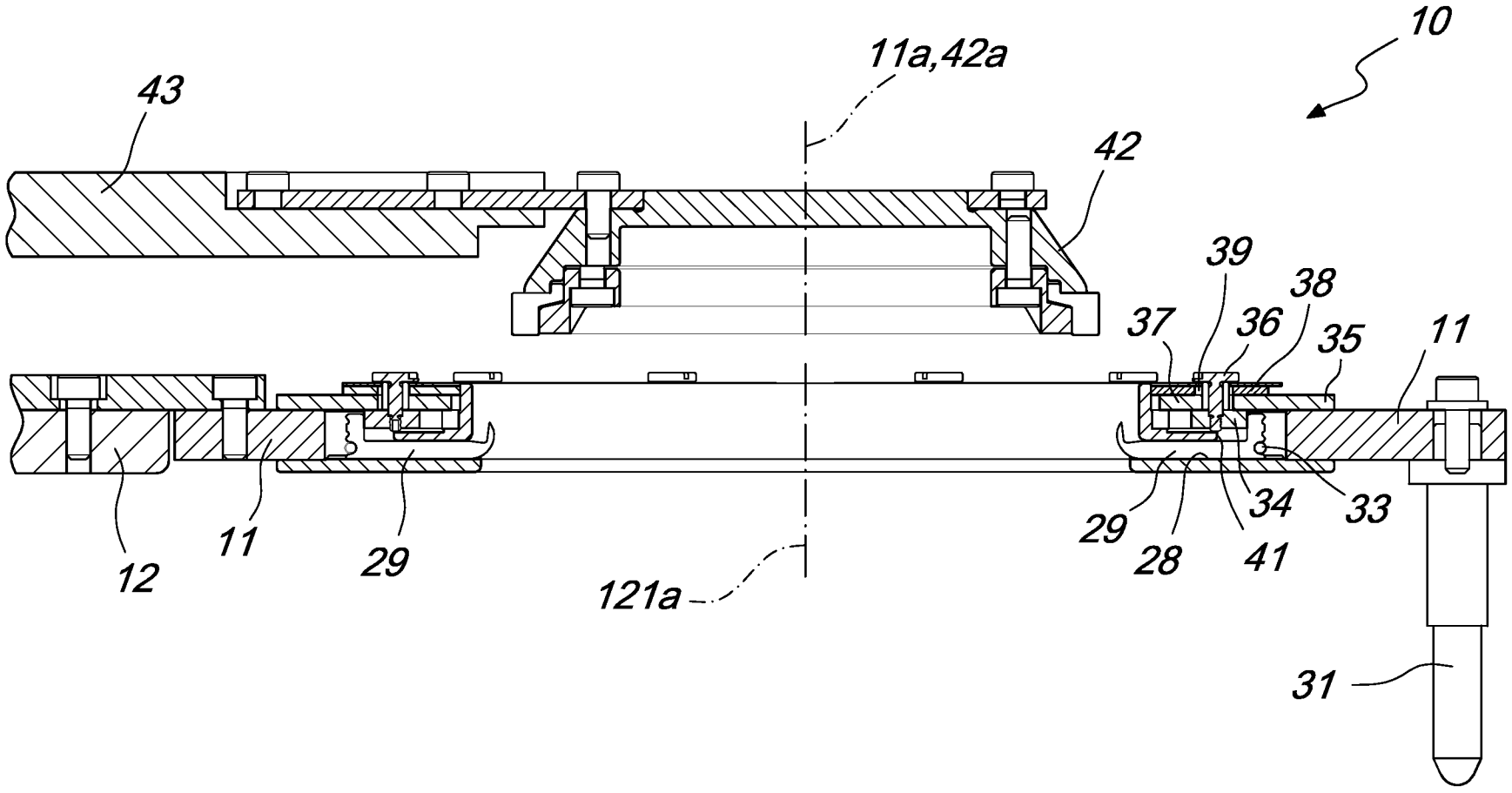

The presser 42, particularly when it is in a position that is coaxial to the pick-up body 11, can move, by means of the actuation of the fluid-operated cylinder 50, from a raised position, in which it is spaced upward from the pick-up body 11, as shown for example in FIGS. 1, la, 3, 5 and 6, to a lowered position, in which it penetrates with the teeth of its perimetric profile between the pick-up elements 29, as shown for example in FIGS. 7, 11 and 12.

Along the trajectory followed by the arm 43 in its rotation about the axis 13*a* there is an abutment 54 which stops the rotation of the arm 43, in the raised position, in a position that substantially corresponds to the intermediate position of the arm 12 between the machine 100 and the additional work station 102, preventing the arm 43 from following the arm 12 in the additional work station 102. Vice versa, when the arm 12 rotates about the axis 13*a* from the additional work station 102 to the machine 100 and reaches the intermediate position in which it has previously abandoned the arm 43, the pin 51 enters the slot 53 and, at the end thereof, i.e., when the pin 51 is coaxial to the seat 52, entrains in its rotation toward the machine 100 the arm 43.

The seat 30 that is present in the end of each pick-up element 29 that is directed toward the axis 11*a* and can be coupled to a needle of the machine 100 can be mated likewise to a spike 62 by means of an axial movement of the pick-up body 11 and by means of a radial movement of the pick-up elements 29 with respect to the spikes 62.

The body 61 can be composed, in a per se known manner, by two annular portions 63*a*, 63*b* which are mutually pivoted about a diametrical axis 64. One of the two annular portions, constituted by the annular portion 63*b*, can be turned over on command with respect to the other annular portion 63*a* about the diametrical axis 64 so as to move each spike 62 of the annular portion 63*b* so that it faces a corresponding spike 62 of the annular portion 63*a*. In the illustrated embodiment, when the two annular portions 63*a*, 63*b* are in a coplanar position, the spikes 62 are directed with their tip downward and the annular portion 63*b* can be turned over about the diametrical axis 64 so as to face the annular portion 63*a* in a downward region.

Furthermore, at the station 102 there is an annular body 151 which can be accommodated coaxially in an annular seat 150 the axis of which coincides with the axis 61*a*. The annular body 151 is connected to the stem of the piston of a fluid-operated center, not shown, which is oriented so that its axis is parallel to the axis 61*a*. This fluid-operated cylinder can be actuated in order to produce the movement in one direction or in the opposite direction of the annular body 151 along the axis 61*a*.

The perimetric profile of the face of the annular body 151 that is directed upward is preferably comb-shaped, with teeth which can be inserted between the pick-up elements 29 of the pick-up device 10 when the pick-up body 11 is moved into the additional work station 102.

The operation of the pick-up device according to the invention is as follows.

The article 101 is produced on the circular knitting machine for hosiery or the like by beginning its production from one axial end and ending it at the opposite axial end.

While the machine 100 is ending the production of the article 101, the pick-up device 10 is located with its pick-up body 11 in the intermediate position between the machine 100 and the additional work station 102 with the pick-up elements 29 in a position that is spaced from the axis 11*a* of the pick-up body 11. The presser 42 is arranged above and coaxially to the pick-up body 11 and is raised with respect to it.

Each loop of knitting of the last row of knitting formed is retained on the needle 123 that produced it. The dial, not shown for the sake of simplicity, which is arranged above and coaxially to the needle cylinder 121, after the cutter, which is integral with the dial, has cut the yarn used to produce the article 101, is spaced upward from the needle cylinder 121 in order to allow the arrangement, above and coaxially to the needle cylinder 121, of the pick-up body 11 of the pick-up device 10 with the corresponding presser 42 arranged above and coaxially to the pick-up body 11, as shown in FIG. 5.

It should be noted that the pick-up device 10 is arranged so that the pick-up body 11 is above the needle cylinder 121 and is then lowered along the axis 11*a*, which coincides with the axis 121*a*, by means of the actuation of the electric motor 27 so that the centering pin 31 enters the adapted seat provided in the supporting structure of the machine 100.

The needle cylinder 121 continues to be actuated with a rotary motion about its own axis 121*a* so that the needles 123, by means of the needle actuation cams, are first raised into the tuck-stitch position and then returned with their head 123*c* below the sinkers 125 to be then raised again to the tuck-stitch position, lifting simultaneously the suction tube 124 so that the loops of knitting of the last row of knitting of the article 101 that have been formed are assuredly in the head 123*c* of the corresponding needle 123 with the latches 123*d* of the needles 123 open. Finally, the needles 123, again by means of the rotation of the needle cylinder 121 with respect to the needle actuation cams, are all raised to the tuck-stitch position together with the suction tube 124. At this point, the rotation of the needle cylinder 121 is stopped and the needle cylinder 121 is locked mechanically so as to exclude a random or accidental rotation thereof during subsequent steps. In this rotational position of the needle cylinder 121, the end 29*a* of each pick-up element 29 that is directed toward the axis 11*a* is radially aligned with the stem 123*b* of a corresponding needle 123.

At this point the fluid-operated cylinder 40 is actuated and, by rotating the movable plate 38, causes the movement of the radial pushers 34 toward the axis 11*a*, thus allowing the pick-up elements 29 to move toward the axis 11*a* by virtue of the action of the thrust applied by the spring 33, as shown in FIGS. 4, 4*a*. The end of each pick-up element 29 that is directed toward the axis 11*a* rests with the seat 30 against the stem 123*b* of the corresponding needle 123 directly below the latch 123*d* of the same needle 123, as shown in FIG. 6 and more particularly in FIGS. 8 and 10, which show exclusively the coupling of a pick-up element 29 to a needle 123.

After the engagement of the pick-up elements 29 against the stem 123*b* of the corresponding needle 123, the pick-up body 11 is raised slightly, by means of the actuation of the electric motor 27, so that the end 29*a* of each pick-up element 29 engages, by means of the seat 30, the stem 123*b* of the needle 123 between the free end of the open latch 123*d* of a needle 123 and the stem 123*b* of said needle 123.

Then the suction tube 124 is lowered and, by means of the actuation of the fluid-operated cylinder 50, the transition of the presser 42 to the lowered position is produced, in which it enters with the teeth of its perimetric profile between the needles 123 and between the pick-up elements 29. As a consequence of this axial movement of the presser 42, the loops of knitting are pushed into the hook-shaped end 29*a* of the pick-up elements 29 below the latches 123*d* of the needles 123, as shown in FIGS. 7 and 9. Furthermore, the pin 51 engages in the seat 52, rendering mutually integral, in rotation about the axis 13*a*, the arm 12 and the arm 43.

The pick-up body 11 of the pick-up device 10 is then raised along its own axis 11*a* with respect to the needle cylinder 121 together with the presser 42 by means of the actuation of the electric motor 27. This lifting, by virtue of the sliding toward the head 123*c* of the corresponding needle 123 of the pick-up elements 29 that previously were arranged with their end 29*a* below the open latch 123*d* of the corresponding needle 123, causes the closure of the latches 123*d* onto the heads 123*c* of the needles 123 and the disengagement of the loops of knitting from the needles 123, as shown in FIG. 11.

In this step, the suction tube 124 is raised again in order to assist the rise of the article 101 and protect the article 101 from contact with the parts of the machine that are located about the needles 123 in the subsequent step.

By means of the actuation of the electric motor 20, the arms 12 and 43 are then rotated about the axis 13*a* so as to transfer the pick-up body 11 of the pick-up device 10 and the presser 42 from the machine 100 to the intermediate position between the machine 100 and the additional work station 102, as shown in FIG. 12. In this intermediate position the fluid-operated cylinder 50 is deactivated so that the arm 43, which supports the presser 42, disengages with its pin 51 from the seat 52.

The rotation of the arm 12 about the axis 13*a* is then completed by means of the electric motor 20 until the pick-up body 11 is arranged so that its axis 11*a* is at the axis 61*a* in the further processing station 102, as shown in FIG. 13. It should be noted that in the completion of the rotation of the arm 12 about the axis 13*a* the arm 43 does not follow the arm 12, since its rotation is blocked by the abutment 54 and the slot 53 slides along the pin 51, disengaging from it. Optionally, in this position the article 101 can be aspirated pneumatically into a tubular body which is arranged below and coaxially to the pick-up body 11.

The pick-up body 11, which is located below the two annular portions 63*a*, 63*b*, which are mutually coplanar, is then raised by means of the actuation of the electric motor 27.

The annular body 151 is then raised along the axis 61*a* and penetrates with the teeth of its perimetric profile between the pick-up elements 29, causing the penetration of the spikes 62 in the knitting.

At this point the article 101 can be turned inside out above the body 61, making it pass axially through it, in a per se known manner, for example by pneumatic suction or by means of a turner tube which can be inserted axially through the body 61.

The annular body 151 is then returned to the lowered position and the pick-up body 11 of the pick-up device 10 is spaced from the additional work station 102 and returned to the intermediate position by means of a lowering produced by the activation of the electric motor 27 and by means of a rotation about the axis 13*a* produced by the actuation of the electric motor 20, as shown in FIG. 15.

In the additional work station 102, work on the article 101 can continue in a per se known manner for example by means of a non-linked sewing of the two annular portions by means of the overturning of the annular portion 63*b* below the annular portion 63*a* and by means of the subsequent sewing, thus closing an axial end of the article 101.

In practice it has been found that the pick-up device according to the invention fully achieves the intended aim and objects.

A further advantage of the pick-up device according to the invention is that it can have a reduced axial space occupation for the pick-up body and therefore can require a minimal lifting of the dial, if it is used on a single-cylinder knitting machine, or of the upper needle cylinder if it is used on a double-acting circular machine.

A further advantage of the pick-up device according to the invention is that it can be used to pick up articles from needles or to transfer articles onto spikes which are arranged according to different cylindrical surfaces having different diameters.

The device thus conceived is susceptible of numerous modifications and variations, all of which are within the protective scope of the appended claims.

The disclosures in Italian Patent Application No. 102019000005838 from which this application claims priority are incorporated herein by reference.

Where technical features mentioned in any claim are followed by reference signs, those reference signs have been included for the sole purpose of increasing the intelligibility of the claims and accordingly such reference signs do not have any limiting effect on the interpretation of each element identified by way of example by such reference signs.

The invention claimed is:

1. A system comprising a circular knitting machine for hosiery, a pick-up device and a station, the station being a sewing or linking station, wherein the pick-up device is configured to pick up a tubular knitted article from the circular knitting machine for hosiery and for transferring the tubular knitted article to a unit adapted to perform additional operations on the article, wherein the unit is arranged in the station, the pick-up device comprising:

an annular pick-up body that supports pick-up elements that can slide relative to the pick-up body along radial directions, each of the pick-up elements having a first end, wherein the pick-up body is configured to be arrangeable coaxially around a needle cylinder of the circular knitting machine for hosiery so that each one of the pick-up elements faces laterally a corresponding needle of the circular knitting machine;

an actuator configured to act on the pick-up elements for their movement toward or away from an axis of the pick-up body, for engagement or disengagement of each one of the pick-up elements with the corresponding needle of the circular knitting machine that the corresponding needle is made to face wherein the first end of each of the pick-up elements is directed towards the axis of the pick-up body; and wherein each one of the pick-up elements is adapted to pick up a loop of knitting held on the corresponding needle;

wherein the pick-up body is movable on command from a pick-up position, in which the pick-up body is configured to be arranged coaxially around the needle cylinder of the circular knitting machine for hosiery, to a release position, in which the pick-up body is configured to be arranged at the station for further processing of the article;

the station comprising:

a handling element provided with a plurality of spikes arranged along a cylindrical surface and are designed to engage the article, wherein the pick-up body, when in the release position, is arranged coaxially to the cylindrical surface, wherein the cylindrical surface is spaced radially in a direction of the axis of the pick-up body with respect to a cylindrical surface along which the first end of each of the pick-up elements directed toward the axis of the pick-up body is arranged, and wherein the first end of each of the pick-up elements is arranged around and radially spaced externally with respect to the plurality of spikes when the pick-up body is in the release position.

2. The system according to claim 1, wherein the first end of each of the pick-up elements directed toward the axis of the pick-up body is provided with a seat which can engage a region of a stem of the corresponding needle which is located proximate to a latch of the corresponding needle on an opposite side with respect to a head of the corresponding needle, and wherein the actuator comprises elastic means configured to act on the pick-up elements for their sliding toward an axis of the pick-up body and radial pushers configured to act on the pick-up elements for their sliding away from the axis of the pick-up body against an action of the elastic means.

3. The system according to claim 1, comprising the pick-up body which is oriented so that its axis is vertical and is mounted on an arm which can rotate on command, with respect to a supporting structure, about a vertical actuation axis, which is spaced from the axis of the pick-up body, for a transition of the pick-up body from the pick-up position to the release position or vice versa.

4. The system according to claim 3, wherein the arm can move on command along the vertical actuation axis.

5. The system according to claim 2, wherein the pick-up body is provided with a plurality of radial slots, each of which slidingly accommodates one of the pick-up elements, the pick-up body supporting the radial pushers that are configured to act on command on the pick-up elements for their sliding away from the axis of the pick-up body in contrast with the action of the elastic means; and a shoulder being provided for delimiting a stroke of the pick-up elements toward the axis of the pick-up body.

6. The system according to claim 1, wherein the first end of each of the pick-up elements directed toward the axis of the pick-up body is hook-shaped that is open upward, and a seat is formed on a back of the hook-shaped first end of each of the pick-up elements.

7. The system according to claim 6, wherein the first end of each of the pick-up elements directed toward the axis of the pick-up body is configured to engage, by means of the seat, the stem of the corresponding needle between a free end of an open latch of a corresponding needle and the stem of the corresponding needle.

8. The system according to claim 5, wherein a second end of each one of the pick-up elements that is opposite with respect to the first end of each one of the pick-up elements directed toward the axis of the pick-up body is heel-shaped which is extended parallel to the axis of the pick-up body and protrudes upward from a corresponding radial slot of the plurality of radial slots;

the second end forming a shoulder directed toward the axis of the pick-up body; and the radial pushers are configured to act on the shoulder in a direction that is opposite with respect to the axis of the pick-up body and the elastic means configured to act on a side of the heel that is opposite with respect to the shoulder.

9. The system according to claim 2, wherein the elastic means are constituted by a helical spring which has an annular extension and is arranged in the pick-up body around the pick-up elements.

10. The system according to claim 1, wherein each one of the radial pushers is shaped with an annular sector and is slidingly supported by the pick-up body along a corresponding direction which is oriented radially with respect to the pick-up body;

each one of the radial pushers are integral with a pair of pins oriented axially with respect to the pick-up body and are mutually angularly spaced around the axis of the pick-up body;

the pair of pins slidingly engaging corresponding first slits, which are mutually parallel and are oriented so as to allow a radial movement of the corresponding radial pusher with respect to the pick-up body and are formed in a fixed annular plate which is fixed coaxially to the pick-up body;

the pins furthermore engaging second slits formed in a movable plate, which is annular and is arranged coaxially to the pick-up body; and the second slits being inclined with respect to the first slits and the movable plate is able to rotate about its own axis with respect to the pick-up body to cause the sliding of the pins along the first slits.

11. The system according to claim 10, wherein the device includes a plate actuator which comprises a linear actuator;

the linear actuator comprises a fluid-operated cylinder having a stem and a piston which is mounted on an arm and is connected with the stem of the piston to the movable plate; and the fluid-operated cylinder is actuatable to actuate the rotation of the movable plate about the axis of the pick-up body.

12. The system according to claim 2, further comprising a presser which has a circular planar shape with a perimetric profile comprising a plurality of aligned protrusions, wherein the presser is arrangeable so as to face coaxially the pick-up body and is axially movable with respect to the pick-up body to penetrate one or more of the plurality of aligned protrusions of its perimetric profile between the pick-up elements.

13. The system according to claim 12, wherein the presser is mounted on a corresponding arm which can rotate integrally or with respect to the arm that supports the pick-up body about the vertical actuation axis.

14. The system according to claim 13, wherein the arm that supports the presser is movable integrally or with respect to the arm that supports the pick-up body along the vertical actuation axis.

* * * * *